US011448203B2

(12) United States Patent
Smith et al.

(10) Patent No.: US 11,448,203 B2
(45) Date of Patent: Sep. 20, 2022

(54) HYDRAULIC RADIAL PISTON DEVICE

(71) Applicant: Eaton Intelligent Power Limited, Dublin (IE)

(72) Inventors: Aaron Smith, Pascagoula, MS (US); Sushant Subhash Bawdhankar, Maharashtra (IN); Aaron Matthew Davis, Ridgeland, MS (US); Jeffrey David Skinner, Madison, MS (US); Kendrick Michael Gibson, Chattanooga, TN (US); Mark Alan Long, Pearl, MS (US); Nicholas John Hansen, Jackson, MS (US); Kendall Otis Lee, Yazoo City, MS (US)

(73) Assignee: Eaton Intelligent Power Limited, Dublin (IE)

( * ) Notice: Subject to any disclaimer, the term of this patent is extended or adjusted under 35 U.S.C. 154(b) by 679 days.

(21) Appl. No.: 15/694,101

(22) Filed: Sep. 1, 2017

(65) Prior Publication Data

US 2018/0073492 A1 Mar. 15, 2018

Related U.S. Application Data

(60) Provisional application No. 62/385,713, filed on Sep. 9, 2016.

(51) Int. Cl.

| | |
|---|---|
| ***F04B 1/1071*** | (2020.01) |
| ***F03C 1/047*** | (2006.01) |
| ***F03C 1/40*** | (2006.01) |
| ***F04B 1/066*** | (2020.01) |

(Continued)

(52) U.S. Cl.

CPC ..... *F04B 1/1071* (2013.01); *F03C 1/046* (2013.01); *F03C 1/047* (2013.01); *F03C 1/0463* (2013.01); *F03C 1/0472* (2013.01); *F04B 1/066* (2013.01); *F04B 1/07* (2013.01); *F04B 53/18* (2013.01)

(58) Field of Classification Search

CPC ..... F01B 1/06; F01B 1/061; F01B 1/0613; F01B 1/0668; F01B 13/068; F03C 1/0438; F03C 1/047; F04B 1/0476; F04B 1/0535; F04B 1/0438; F04B 1/047; F04B 1/1071; F04B 13/065; F04B 1/07

See application file for complete search history.

(56) References Cited

U.S. PATENT DOCUMENTS

2004/0065192 A1* 4/2004 Akasaka ..... F01B 1/06 91/491

2016/0208610 A1 7/2016 Skinner et al.

FOREIGN PATENT DOCUMENTS

DE 10 2008 018035 A1 10/2009

FR 3 011 045 A1 3/2015

WO WO-2015103271 A2 * 7/2015 ..... F04B 1/1071

OTHER PUBLICATIONS

Schober, "DE102008018035A_MT.pdf"—Machine Translation, (2009) (Year: 2009).*

* cited by examiner

*Primary Examiner* — Kenneth J Hansen

(74) *Attorney, Agent, or Firm* — Merchant & Gould P.C.

(57) ABSTRACT

A hydraulic radial piston device includes a housing, a pintle having a pintle shaft, a rotor mounted on the pintle shaft and defining a plurality of cylinders, and a plurality of pistons displaceable in the cylinders. The radial piston device further includes a piston ring that provides an interface for the pistons. The radial piston device includes various configurations for improving the performance and efficiency of the device.

44 Claims, 26 Drawing Sheets

(51) Int. Cl.
*F04B 1/07* (2006.01)
*F04B 53/18* (2006.01)

HYDRAULIC RADIAL PISTON DEVICE

CROSS-REFERENCE TO RELATED APPLICATION(S)

This application claims the benefit of U.S. Patent Application Ser. No. 62/385,713, titled HYDRAULIC RADIAL PISTON DEVICE, filed Sep. 9, 2016, the disclosure of which is hereby incorporated by reference in its entirety.

BACKGROUND

Radial piston devices, either pumps or motors, are used in various hydraulic applications and are characterized by a rotor rotatably engaged with a pintle. The rotor has a number of radially oriented cylinders disposed around the rotor and supports a number of pistons in the cylinders. A head of each piston contacts an outer piston ring that is not axially aligned with the rotor. A stroke of each piston is determined by the eccentricity of the piston ring with respect to the rotor. When the device is in a pump configuration, the rotor can be rotated by operation of a drive shaft associated with the rotor. The rotating rotor draws hydraulic fluid into the pintle and forces the fluid outward into a first set of the cylinders so that the pistons are displaced outwardly within the first set of the cylinders. As the rotor further rotates around the pintle, the first set of the cylinders becomes in fluidic communication with the outlet of the device and the piston ring pushes back the pistons inwardly within the first set of the cylinders. As a result, the fluid drawn into the first set of the cylinders is displaced into the outlet of the device through the pintle.

SUMMARY

In general terms, this disclosure is directed to a hydraulic radial piston device. In one possible configuration and by non-limiting example, the radial piston device includes various configurations for improving the performance and efficiency of the device. Various aspects are described in this disclosure, which include, but are not limited to, the following aspects.

In general, a hydraulic radial piston device includes a housing, a pintle, a rotor, a plurality of pistons, and a drive shaft. In other examples, the radial piston device may further include a ring displacement device. The pintle is attached to the housing and having a pintle shaft. The rotor is mounted on the pintle shaft and configured to rotate relative to the pintle shaft about a rotor axis of rotation. The rotor defines a plurality of cylinders. The plurality of pistons are displaceable in the plurality of cylinders, respectively. The piston ring is disposed around the rotor and has a piston ring axis of rotation. The piston ring is configured to rotate about the piston ring axis of rotation as the rotor rotates relative to the pintle shaft about the rotor axis of rotation. The drive shaft is rotatably supported within the housing and rotatable with the rotor. In some examples, the ring displacement device is configured to move the piston ring through a range of movement within the housing between a first position in which the radial piston device has a minimum displacement of hydraulic fluid per each rotation of the rotor and a second position in which the radial piston device has a maximum displacement of hydraulic fluid per each rotation of the rotor.

The radial piston device may include the following elements and configurations, either individually or in any combination thereof.

In certain examples, the pintle may include an integrated bearing surface configured to provide a bearing surface against which the rotor rotates. The integrated bearing surface may be integrally formed to surround a rotor inlet communication port and a rotor outlet communication port. The rotor inlet communication port is formed on the pintle shaft and configured to be selectively in fluid communication with the plurality of cylinders. The rotor outlet communication port is formed on the pintle shaft and configured to be selectively in fluid communication with the plurality of cylinders.

In certain examples, the pintle may include a pintle wall extending at least partially along a pintle inlet channel defined by the pintle shaft. The pintle wall may be configured to separate the pintle inlet channel into two sections.

In certain examples, the pintle may include a lubrication groove provided on the integrated bearing surface and configured to feed hydraulic fluid for lubricating the integrated bearing surface. In some embodiments, the lubrication groove may include a first pintle lubrication groove provided on the integrated bearing surface between a pintle inlet end and one of the rotor inlet communication port and the rotor outlet communication port. In addition or alternatively, the lubrication groove may include a second pintle lubrication groove provided on the integrated bearing surface between a pintle outlet end and one of the rotor inlet communication port and the rotor outlet communication port.

In certain examples, the pintle may include an inlet recess being depressed from the integrated bearing surface and the rotor inlet communication port is defined on the inlet recess. In some embodiments, the pintle may include an outlet recess being depressed from the integrated bearing surface and the rotor outlet communication port is defined on the outlet recess.

In certain examples, the pintle may include a timing recess configured to adjust timing of fluid communication between the rotor inlet communication port and the plurality of cylinders. The timing recess may include a first inlet timing recess and a second inlet timing recess. The first and second inlet timing recesses are formed on the pintle shaft and abutted to opposite sides of the inlet recess, respectively, so as to be in fluid communication with the rotor inlet communication port through the inlet recess. In other embodiments, in addition or alternatively, the pintle may include a timing recess configured to adjust timing of fluid communication between the rotor outlet communication port and the plurality of cylinders. The timing recess may include a first outlet timing recess and a second outlet timing recess. The first and second outlet timing recesses may be formed on the pintle shaft and abutted to opposite sides of the outlet recess, respectively, so as to be in fluid communication with the rotor outlet communication port through the outlet recess.

In certain examples, the plurality of cylinders of the rotor may be arranged in a plurality of rows of cylinders. The rows extend about the rotor axis of rotation, and each row of cylinders includes a pair of radially oriented cylinders. The rotor may further include a plurality of rotor fluid ports. Each rotor fluid port is in fluid communication with the pair of radially oriented cylinders and is alternatively in fluid communication with either the rotor inlet communication port of the pintle shaft or the rotor outlet communication port of the pintle shaft. Each rotor fluid port may include a first rotor port channel connected to one cylinder of the pair of radially oriented cylinders and a second rotor port channel connected to the other cylinder of the pair of radially oriented cylinders. The first rotor port channel and the second rotor port channel may be formed by cross-drilling.

In certain examples, the plurality of cylinders of the rotor may be arranged in a plurality of rows of cylinders. The rows are arranged about the rotor axis of rotation. The rotor may further include at least one flat face arranged adjacent at least one of the plurality of rows of cylinders and extending axially on an outer surface of the rotor to include openings of the at least one of the plurality of rows of cylinders.

In certain examples, the piston ring may have a V-shape configuration on an inner diameter thereof. In some embodiments, the piston ring has an inner diameter and an outer diameter. The inner diameter and the outer diameter axially extend between opposite axial end faces. The inner diameter has a first radius measured around the piston ring axis at a fillet point of the piston ring and a second radius measured around the piston ring axis at the axial end faces. The first radius may be greater than the second radius. In some embodiments, radii measured around the piston ring axis at the axial end faces may be different while being both smaller than the first radius.

In certain examples, the piston ring has an inner diameter and an outer diameter. The inner diameter and the outer diameter axially extend between opposite axial end faces. The piston ring may include one or more radially extending grooves formed on at least one of the axial end faces between the inner diameter and the outer diameter and configured to enable hydraulic fluid to travel between the inner diameter and the outer diameter.

In certain examples, the drive shaft having a driving end and a power transfer end. The drive shaft includes a shaft body at the driving end and a power transfer flange at the power transfer end. The power transfer flange is configured to be connected to the rotor and defines a flow passage being in fluid communication with a pintle inlet channel of the pintle shaft. The drive shaft may include a crossbar provided to the power transfer flange. The crossbar may extend across the flow passage and be offset from a base of the power transfer flange.

In certain examples, the drive shaft includes at least one engagement element provided on the power transfer flange, and the rotor includes at least one engagement element provided on an inlet end of the rotor. The radial piston device may further include a coupling element disposed between the drive shaft and the rotor and configured to couple the draft shaft and the rotor to transfer torque therebetween. The coupling device may include one or more coupling recesses for receiving the at least one engagement element of the power transfer flange and the at least one engagement element of the rotor. The coupling recesses have a radially-extending lateral surface configured to contact the at least one engagement element of the power transfer flange or the at least one engagement element of the rotor. In certain examples, the radially-extending lateral surface may include a crowned surface. In some embodiments, the at least one coupling recess includes one or more rotor engagement recesses and one or more drive shaft engagement recesses. The rotor engagement recesses are configured to engage the at least one engagement element of the rotor and have a radially-extending lateral surface configured to abut with the at least one engagement element of the rotor. The radially-extending lateral surface may have a crowned portion. The drive shaft engagement recesses are configured to engage the at least one engagement element of the drive shaft and have a radially-extending lateral surface configured to abut with the at least one engagement element of the drive shaft. The radially-extending lateral surface may have a crowned portion. In other embodiments, alternatively, such a crowned portion or surface is provided to the engagement elements of the rotor and/or the engagement elements of the drive shaft while the radially-extending lateral surfaces of the coupling device are made flat or in other shapes. In yet other embodiments, some of the radially-extending lateral surfaces of the coupling device have crowned portions and the other surfaces are made flat or in other shapes, while some of the engagement elements of the rotor and/or the drive shaft that correspond to the other radially-extending lateral surfaces of the coupling device have crowned portions or surfaces.

In certain examples, the radial piston device may further include a bearing element disposed between an inner surface of the housing and the power transfer flange of the drive shaft. The bearing element may provide an inner bearing surface against which the power transfer flange slides as the drive shaft rotates relative to a drive shaft axis of rotation. The bearing element may include at least one groove formed on the inner bearing surface and extending a portion of an axial width of the bearing element. In some embodiments, the at least one groove includes a first groove and a second groove. The first groove axially extends and is open in a first axial direction and closed in a second axial direction opposite to the first axial direction, and the second groove axially extends and is open in the second axial direction and closed in the first axial direction. In certain examples, the first and second grooves may extend about 30% to about 70% of the axial width of the bearing element.

In certain examples, the radial piston device may further include a thrust plate disposed behind the rotor and configured to axially push the rotor toward the drive shaft. In some embodiments, the thrust plate may include one or more spring elements configured to exert axial force on the rotor toward the drive shaft. In some embodiments, the spring constant of the spring elements are adjustable.

In certain examples, the radial piston device may further include a first bearing element and a second bearing element both disposed within the housing and configured to rotatably support the drive shaft. The drive shaft may include an extended portion radially extending over a bearing seat of the drive shaft on which the first bearing element is arranged. The extended portion of the drive shaft may axially seat on the first bearing element to receive axial thrust force applied to the drive shaft from the rotor. In some embodiments, the first bearing element is a roller bearing and the second bearing element is a journal bearing.

In certain examples, the ring displacement device is configured to move the piston ring through a range of movement within the housing between a first position in which the radial piston device has a minimum displacement of hydraulic fluid per each rotation of the rotor and a second position in which the radial piston device has a maximum displacement of hydraulic fluid per each rotation of the rotor. The ring displacement device may include a ring assembly. The ring assembly may include a cam ring and a bearing element fitted to the cam ring and provide a bearing surface for the piston ring. In some embodiments, the bearing element is made of bronze.

In certain examples, the ring displacement device may further include a control device having an anti-slip element configured to prevent the ring assembly from slipping on an inner surface of the housing. The anti-slip element may include a pivot pin. The pivot pin may have a groove to receive hydraulic fluid to provide a hydrostatic bearing pad interface.

In certain examples, the radial piston device may further include a ring coupling element configured to couple the drive shaft with the piston ring. The coupling element is configured to transfer a torque from the drive shaft to the piston ring and permit the piston ring to radially slide relative to the drive shaft.

In certain examples, the rotor includes an even number of cylinders configured to receive an even number of pistons, respectively.

The above features and advantages and other features and advantages of the present teachings are readily apparent from the following detailed description for carrying out the present teachings when taken in connection with the accompanying drawings.

DETAILED DESCRIPTION

Figure 1:
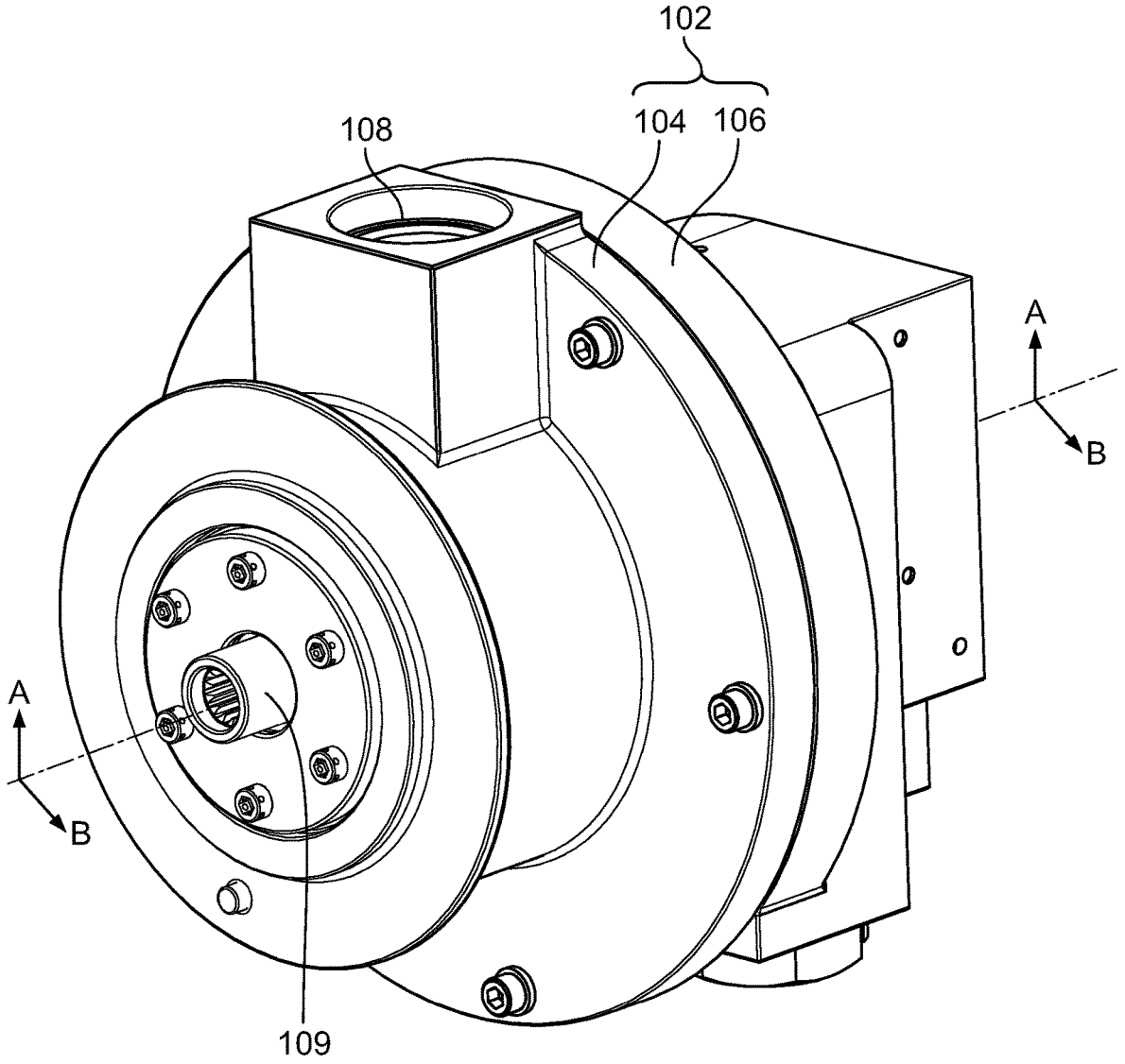
FIG. 1 is a perspective view of an example hydraulic radial piston device in accordance to the present disclosure.

Various embodiments will be described in detail with reference to the drawings, wherein like reference numerals represent like parts and assemblies throughout the several views.

Figure 2:
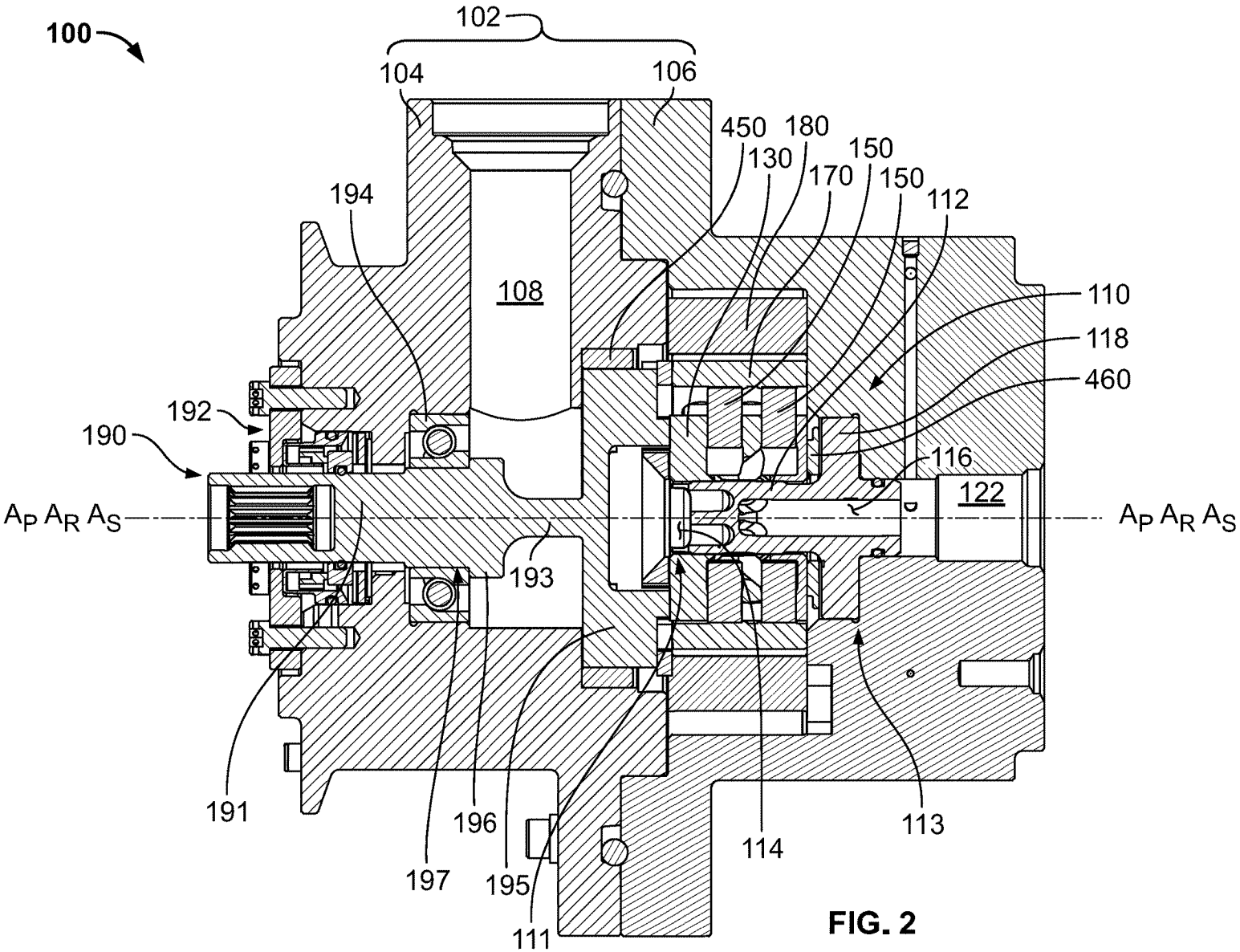
FIG. 2 is a side cross sectional view of the radial piston device, taken along line A-A of FIG. 1.
Figure 3:
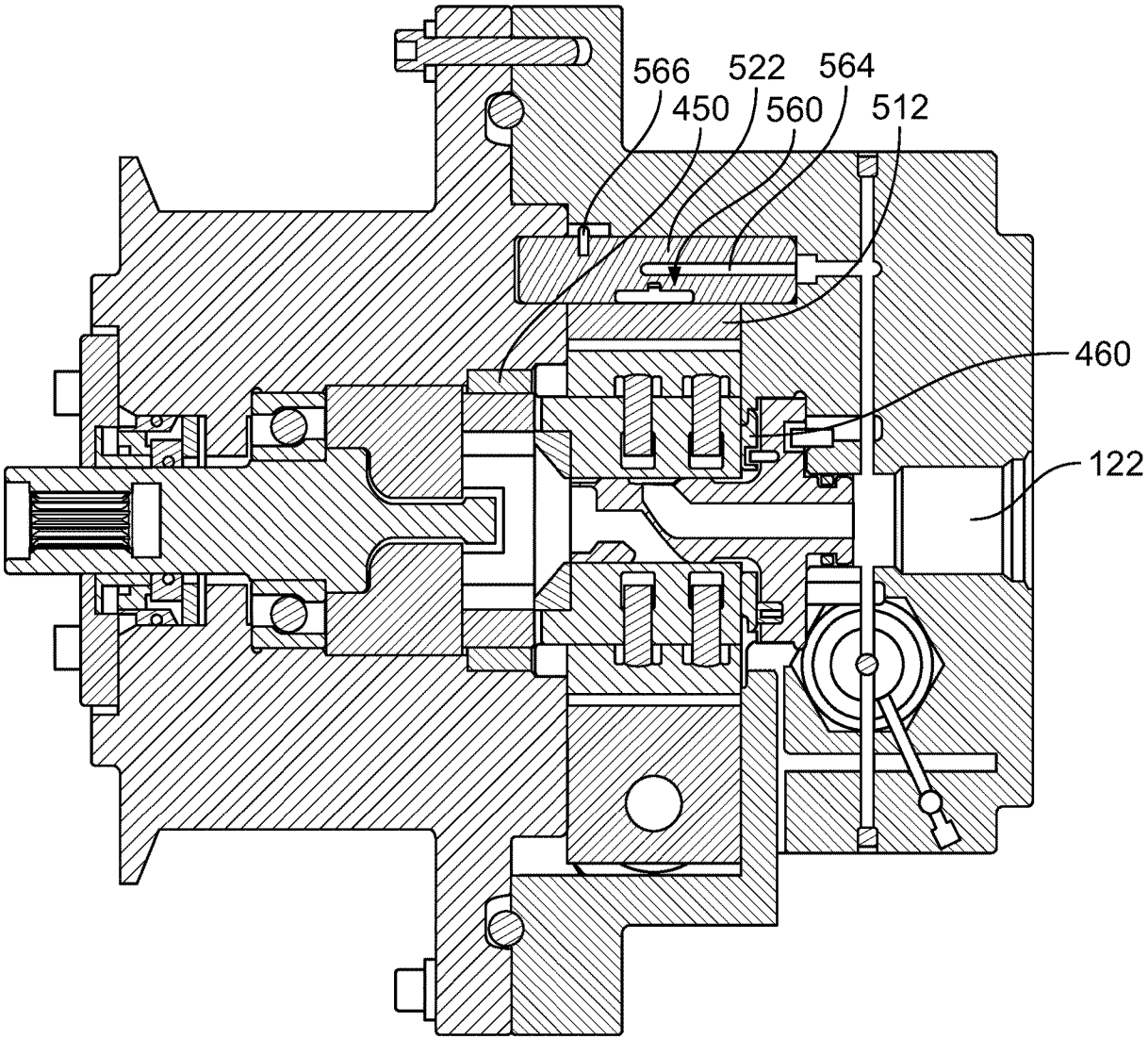
FIG. 3 is a side cross sectional view of the radial piston device, taken along line B-B of FIG. 1.
Figure 4:
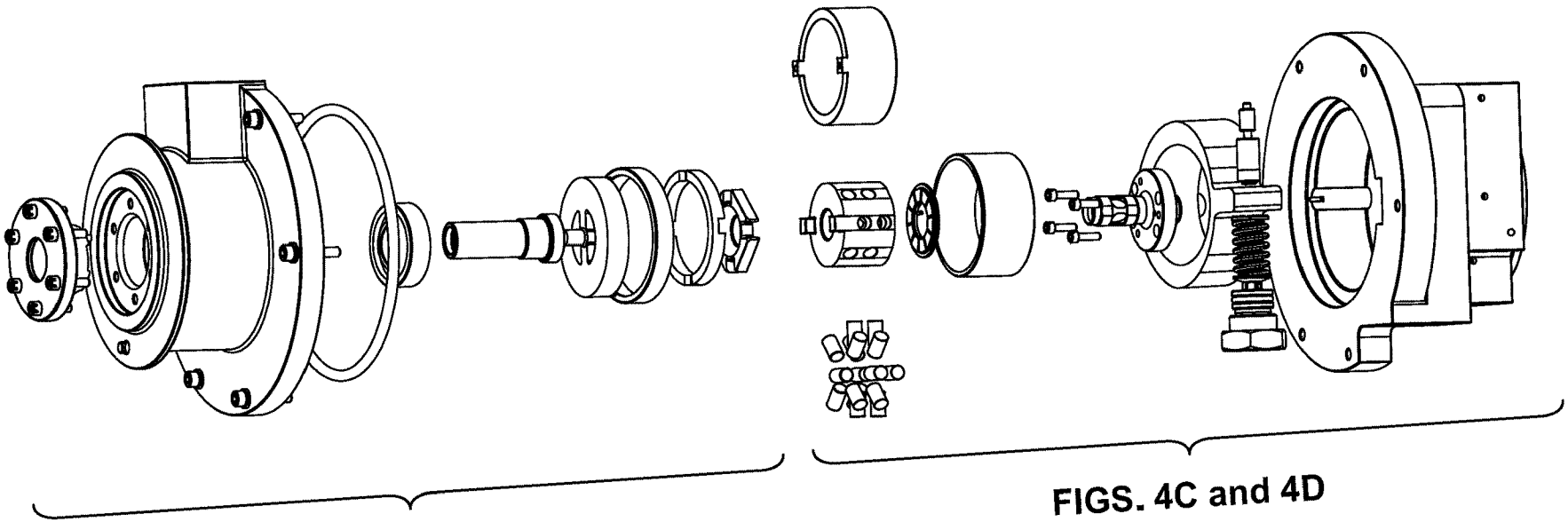
FIG. 4 is an exploded view of the radial piston device of FIG. 1.
Figure 4A:
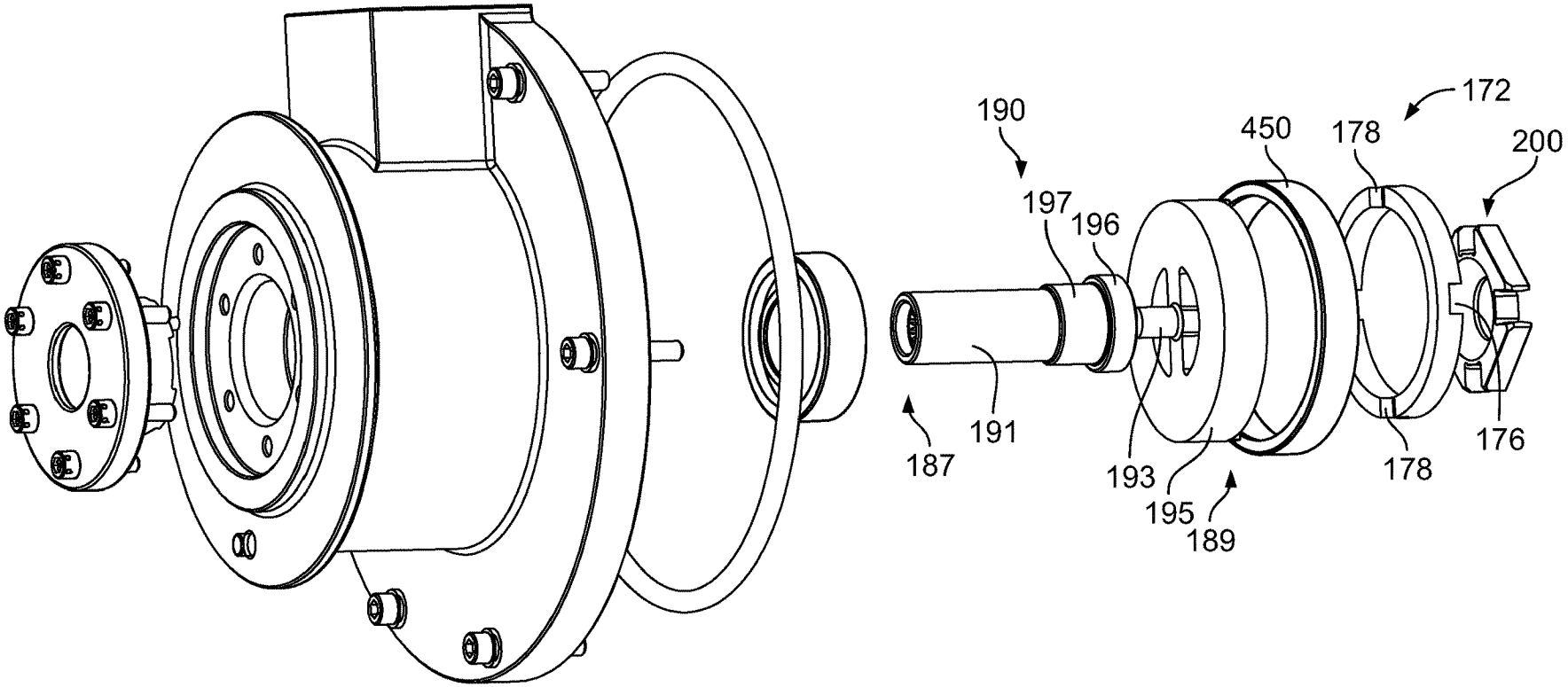
FIG. 4A is a portion of the exploded view in FIG. 4.
Figure 4B:
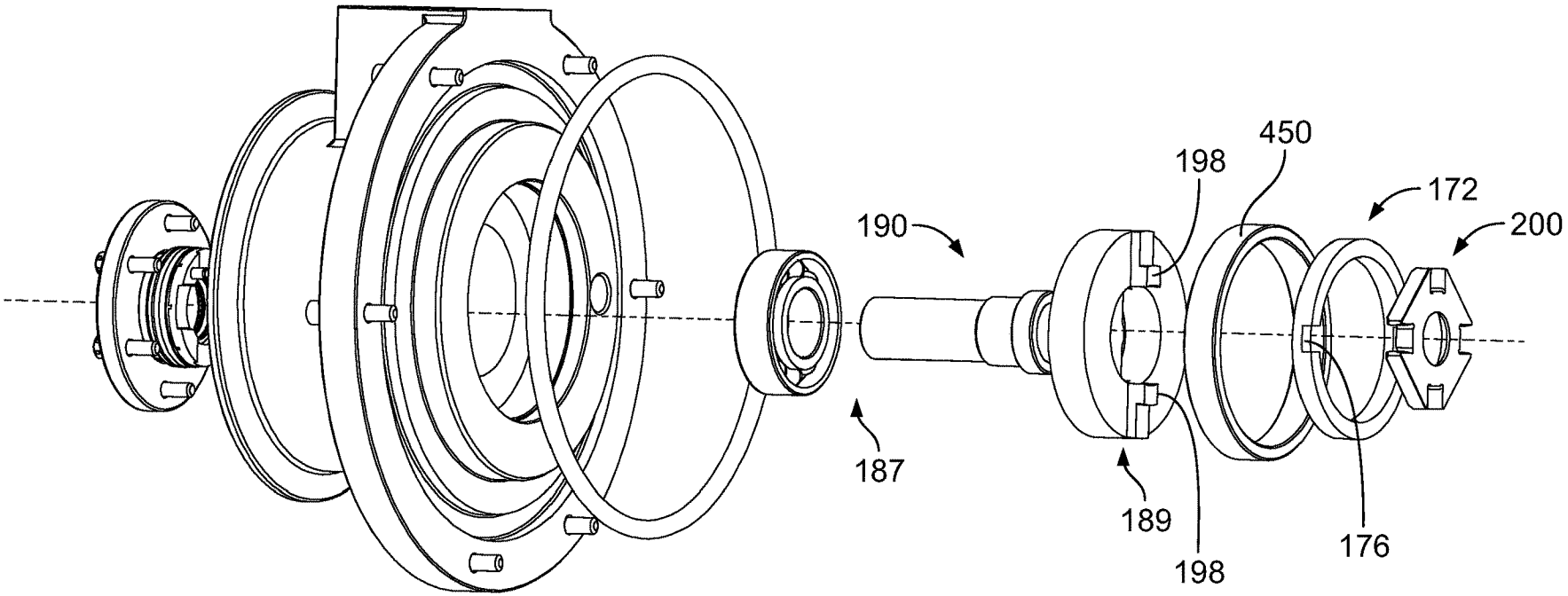
FIG. 4B is a different view of the portion of FIG. 4A.
Figure 4C:
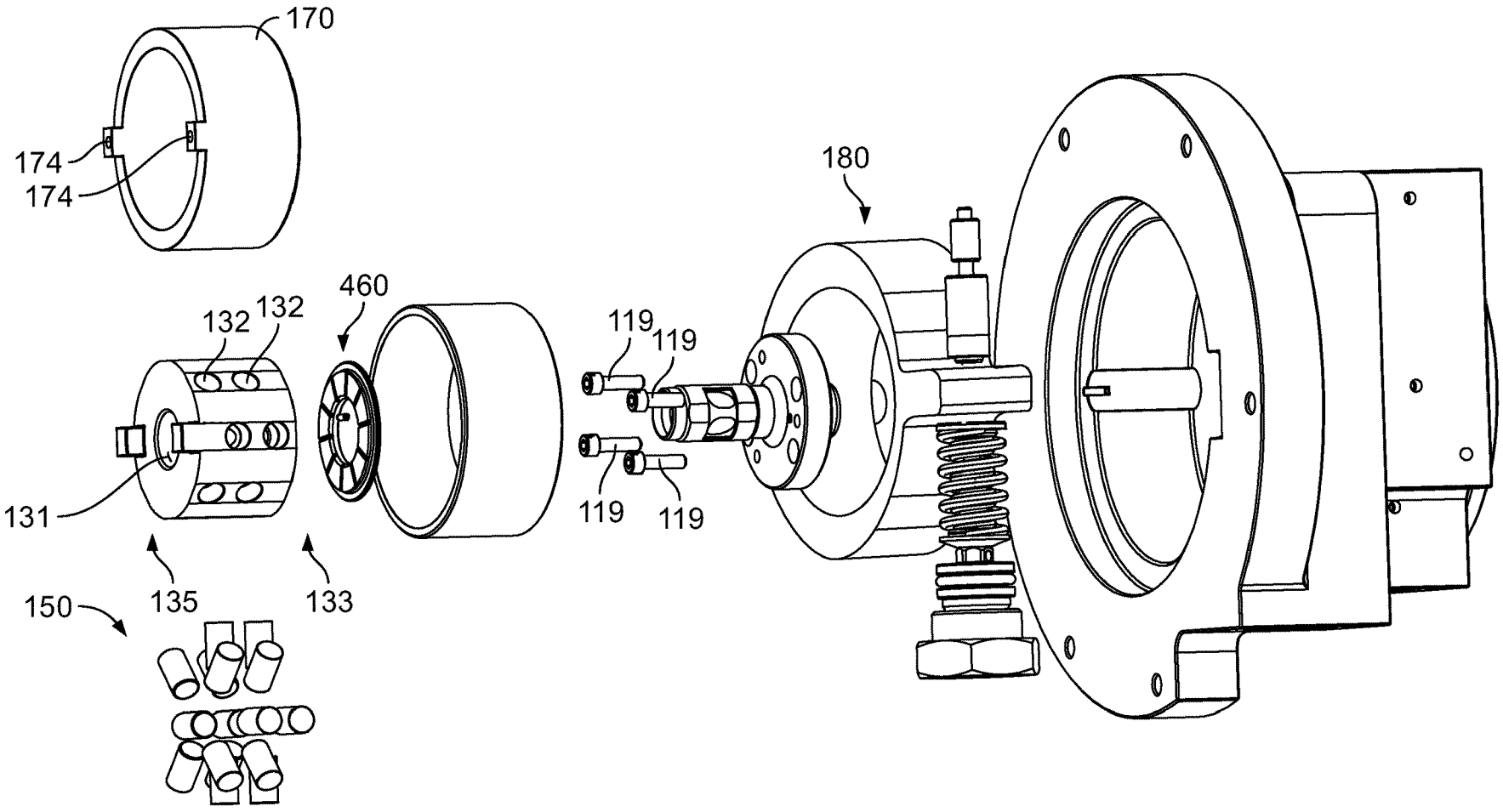
FIG. 4C is the other portion of the exploded view in FIG. 4.
Figure 4D:
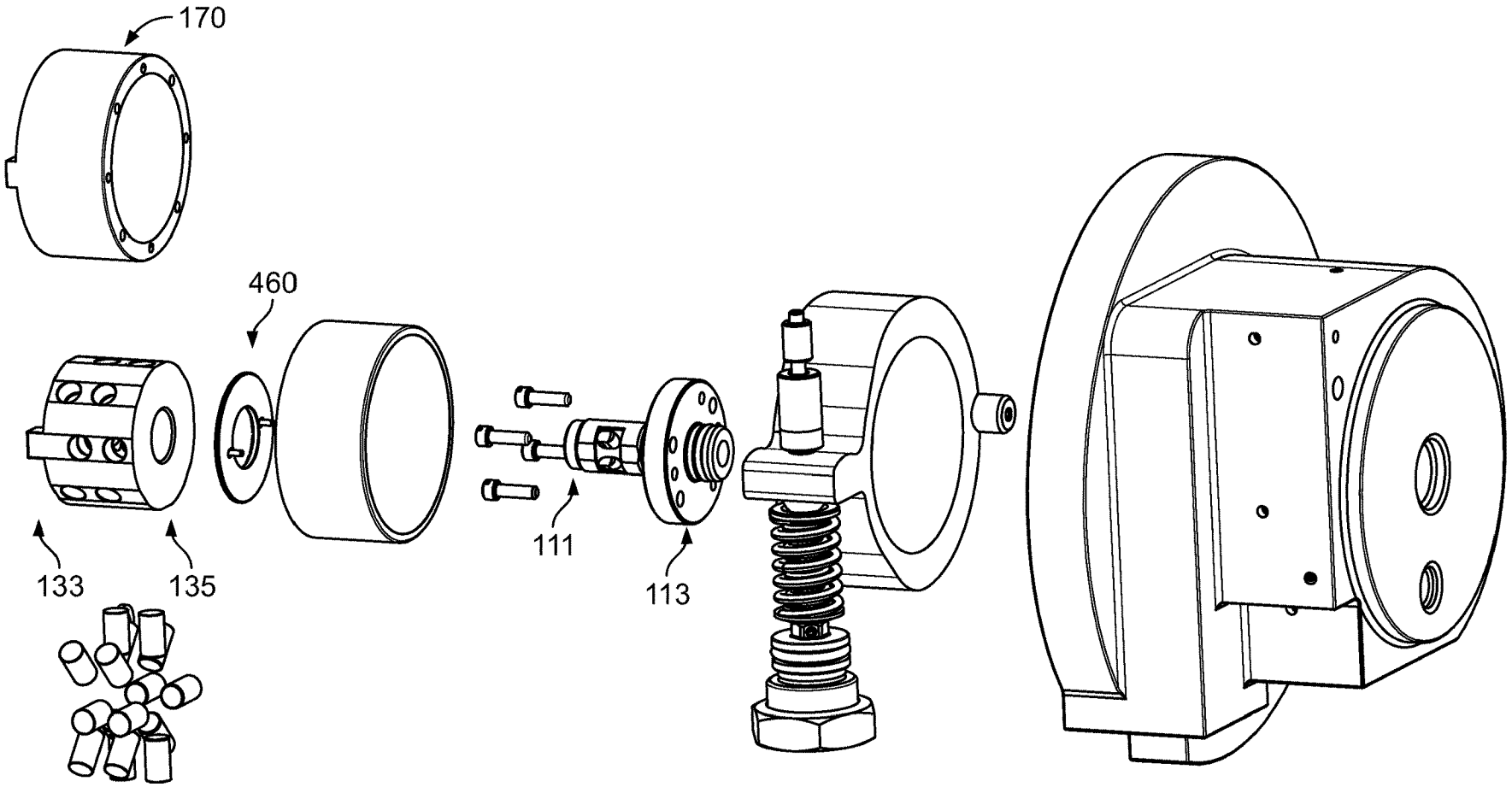
FIG. 4D is a different view of the portion of FIG. 4C.

Referring to FIGS. 1-4, a hydraulic radial piston device 100 is described in accordance with one example of the present disclosure. In particular, FIG. 1 is a perspective view of an example hydraulic radial piston device 100. FIG. 2 is a side cross sectional view of the radial piston device 100, taken along line A-A of FIG. 1, and FIG. 3 is another side cross sectional view of the radial piston device 100, taken along line B-B of FIG. 1. FIG. 4 is an exploded view of the radial piston device 100 of FIG. 1. FIGS. 4A and 4B are a portion of the exploded view in FIG. 4, and FIGS. 4C and 4D are the other portion of the exploded view in FIG. 4.

The radial piston device 100 may be used in both motor and pump applications, as required. Certain differences between motor and pump applications are described herein when appropriate, but additional differences and similarities would also be apparent to a person of skill in the art. The radial piston device disclosed herein exhibits high power density, is capable of high speed operation, and has high efficiency. Although the technology herein is described in the context of radial piston devices, the benefits of the technologies described may also be applicable to any device in which the pistons are oriented between an axial position and a radial position.

In general, the radial piston device 100 includes a housing 102, a pintle 110, a rotor 130, a plurality of pistons 150, a piston ring 170 (also referred to herein as a thrust ring), a ring displacement device 180, and a drive shaft 190. The radial piston device 100 may be used as a pump or a motor. When the device 100 operates as a pump, torque is input to the drive shaft 190 to rotate the rotor 130. When the device 100 operates as a motor, torque from the rotor 130 is output through the drive shaft 190.

As illustrated, the housing 102 may be configured as a two-part housing that includes a drive shaft housing 104 and a rotor housing 106. The drive shaft housing 104 includes a hydraulic fluid inlet 108 through which hydraulic fluid is drawn into the drive shaft housing 104 when the device 100 operates as a pump. The rotor housing 106 includes a hydraulic fluid outlet 122 through which hydraulic fluid is discharged when the device 100 operates as a pump.

The pintle 110 has a first pintle end 111 (also referred to herein as a pintle inlet end) and a second pintle end 113 (also referred to herein as a pintle outlet end) that is opposite to the first pintle end along a pintle axis $A_P$ (FIG. 2). The pintle 110 includes a pintle shaft 112 that protrudes from the second pintle end 113 of the pintle 110 along the pintle axis $A_P$ so that the pintle axis $A_P$ extends through a length of the pintle shaft 112. The pintle shaft 112 has a cantilevered configuration and includes a base end positioned adjacent the second pintle end 113 of the pintle 110 and a free end positioned adjacent the first pintle end 111. The pintle 110 is received within the rotor housing 106 and fixed to the rotor housing 106 at the second pintle end 113 of the pintle 110.

The pintle 110 includes a mounting flange 118 at the second pintle end 113 of the pintle 110, and the mounting flange 118 is attached to the rotor housing 106 via fasteners 119.

The pintle shaft 112 defines a pintle inlet 114 (also referred to herein as a pintle inlet channel) and a pintle outlet 116 (also referred to herein as a pintle outlet channel) therethrough. The pintle inlet 114 and the pintle outlet 116 are substantially aligned with the pintle axis $A_P$. The pintle inlet 114 is in fluidic communication with the hydraulic fluid inlet 108, and the pintle outlet 116 is in fluidic communication with the hydraulic fluid outlet 122.

As also illustrated in FIGS. 5-8, the pintle inlet channel 114 extends between a pintle inlet port 302 and a rotor inlet communication port 312. The pintle inlet port 302 of the pintle 110 is in fluid communication with the hydraulic fluid inlet 108 at the first pintle end 111. The rotor inlet communication port 312 is configured as an opening formed on the pintle shaft 112 to be in fluid communication with the pintle inlet channel 114. In some examples, the rotor inlet communication port 312 is defined on the pintle shaft 112 between the first pintle end 111 and the second pintle end 113. As discussed herein, the rotor inlet communication port 312 of the pintle 110 is arranged to be selectively in fluid communication with rotor fluid ports 134 of the rotor 130 as the rotor 130 rotates around the pintle shaft 112.

The pintle outlet channel 116 extends between a pintle outlet port 304 and a rotor outlet communication port 314. The pintle outlet port 304 of the pintle 110 is in fluid communication with the hydraulic fluid outlet 122 at the second pintle end 113. The rotor outlet communication port 314 is configured as an opening formed on the pintle shaft 112 to be in fluid communication with the pintle outlet channel 116. In some examples, the rotor inlet communication port 312 is defined on the pintle shaft 112 between the first pintle end 111 and the second pintle end 113. The rotor outlet communication port 314 of the pintle 110 is arranged to be selectively in fluid communication with rotor fluid ports 134 of the rotor 130 as the rotor 130 rotates around the pintle shaft 112. In some examples, the rotor inlet communication port 312 is arranged substantially opposite to the rotor outlet communication port on the pintle shaft 112.

The rotor 130 defines a bore 131 that allows the rotor 130 to be mounted on the pintle shaft 112. The rotor 130 has an inlet end 133 and an outlet end 135 that is opposite to the inlet end 133 along a rotor axis of rotation $A_R$. The rotor axis $A_R$ extends through the length of the pintle shaft 112 and is coaxial with the pintle axis $A_P$. The rotor 130 is mounted on the pintle shaft 112 so that the outlet end 135 of the rotor 130 is arranged adjacent the second pintle end 113 of the pintle 110, which is adjacent the mounting flange 118 thereof. The inlet end 133 of the rotor 130 is coupled to the drive shaft 190 as explained below. While mounted on the pintle shaft 112, the rotor 130 rotates along the rotor axis of rotation $A_R$. In some examples, the rotor 130 is driven by the drive shaft 190 where the radial piston device 100 operates as a pump.

The rotor 130 defines a number of radial cylinders 132, each of which receives a piston 150. In the depicted example, the cylinders 132 are in paired configurations such that two cylinders 132 are located adjacent each other along a linear axis parallel to the rotor axis $A_R$.

Figure 11:
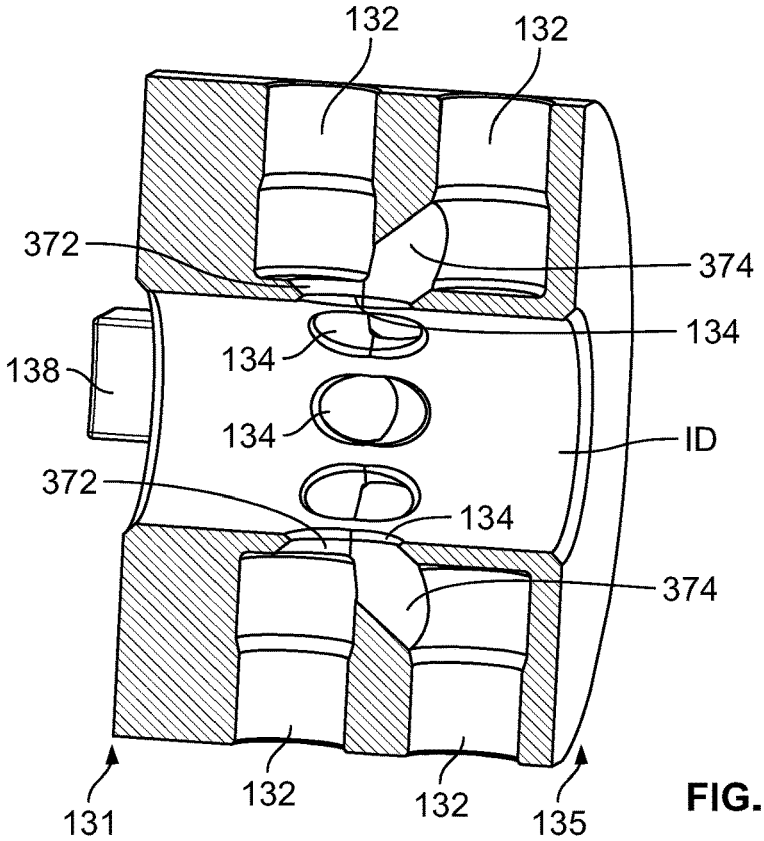
FIG. 11 is a cross sectional view of the rotor of FIG. 10.

Further, as also shown in FIG. 11, the rotor 130 includes rotor fluid ports 134. In some examples, each of the rotor fluid ports 134 is in fluid communication with a pair of adjacent cylinders 132 that are linearly aligned along a linear axis parallel to the rotor axis $A_R$. Each of the rotor fluid ports 134 is alternatively in fluid communication with either the rotor inlet communication port 312 of the pintle 110 (thereby in fluid communication with the pintle inlet channel 114) or the rotor outlet communication port 314 of the pintle 110 (thereby in fluid communication with the pintle outlet channel 116), depending on a rotational position of the rotor 130 relative to the pintle 110 about the rotor axis $A_R$.

The pistons 150 are received in the radial cylinders 132 defined in the rotor 130 and displaceable in the radial cylinders 132, respectively. Each piston 150 is in contact with the piston ring 170 at a head portion of the piston 150. In some examples, the piston 150 is configured to be shoeless such that the head portion of the piston 150 is configured to directly contact with an inner surface of the piston ring 170.

The piston ring 170 is supported radially by the rotor housing 106 and rotatably mounted in the rotor housing 106. The piston ring 170 may be supported with the ring displacement device 180. In some examples, the piston ring 170 is coupled with, and driven by, the drive shaft 190 where the radial piston device 100 operates as a pump. In other examples, the piston ring 170 is not coupled with the drive shaft 190, and rotates independently as the rotor 130 rotates about the rotor axis $A_R$ of rotation.

Figure 25:
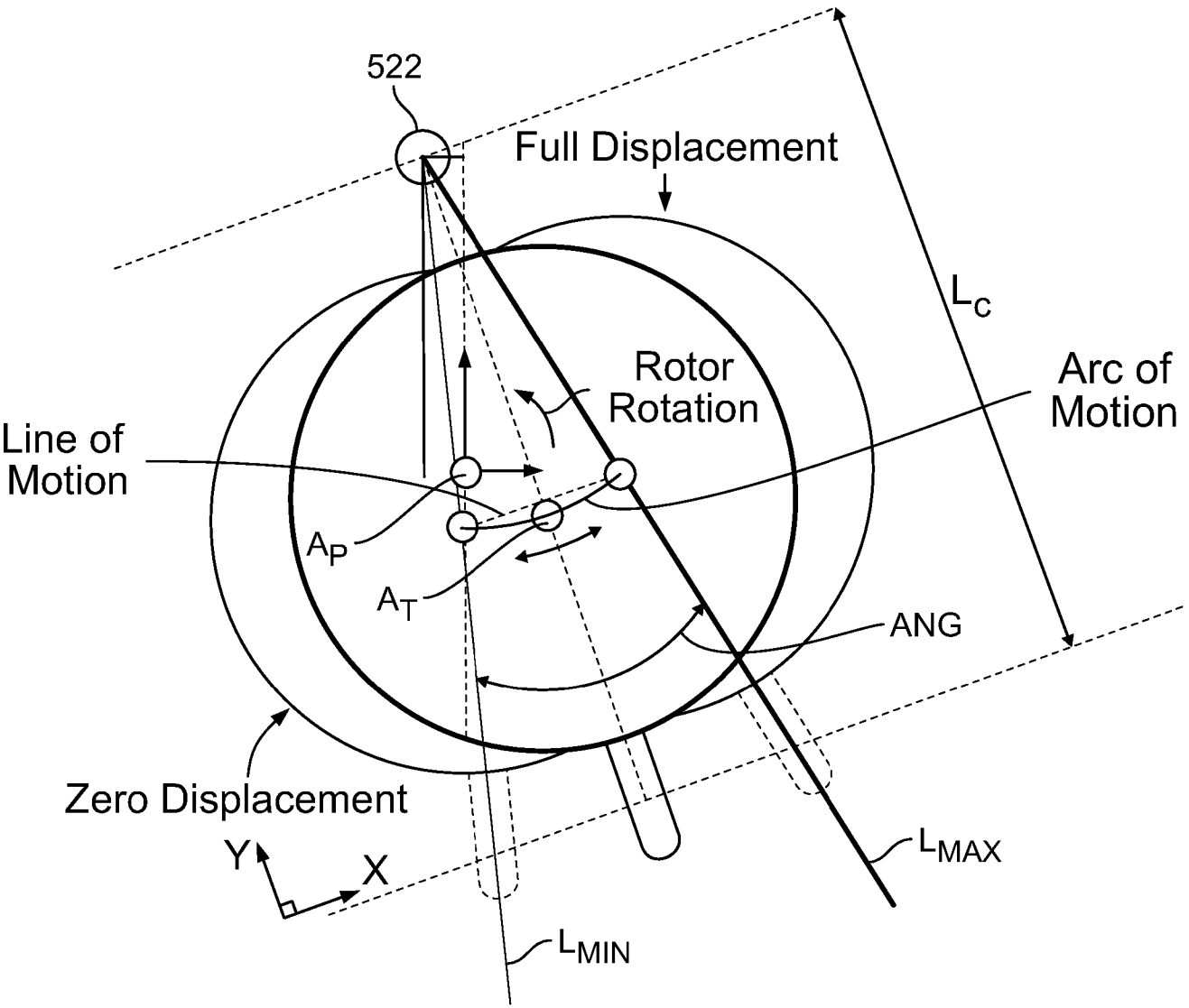
FIG. 25 illustrates a movement of the ring displacement device between the maximum displacement operation and the minimum displacement operation.

The ring displacement device 180 operates to move the piston ring 170 through a range of movement within the housing 102 such that a piston ring axis of rotation $A_T$ is offset from the rotor axis of rotation $A_R$ in operation (FIG. 25 for example). Depending on the displacement of the piston ring 170 relative to the pintle shaft 112 and the rotor 130, different flow rates of hydraulic fluid can be produced per each rotation of the rotor 130. In some examples, the ring displacement device 180 operates to control the radial piston device 100 from a minimum displacement operation to a maximum displacement operation. In the minimum displacement operation, the device 100 operates to pump a predetermined minimum amount of hydraulic fluid therethough. In some embodiments, in the minimum displacement operation, the device 100 is configured to pump no hydraulic fluid therethrough. In the maximum displacement, the device 100 operates to pump hydraulic fluid in its full capacity. In this document, the maximum displacement operation is also referred to as a full displacement operation. In some embodiments, the radial piston device 100 can gradually change its operations between the minimum displacement operation and the maximum displacement operation.

The drive shaft 190 is at least partially located within the drive shaft housing 104. The drive shaft 190 has a driving end 187 and a power transfer end 189, which is opposite to the driving end 187 along a drive shaft axis of rotation $A_S$. An oil seal assembly 192 surrounds the drive shaft 190 at the driving end 187 and prevents hydraulic fluid from inadvertently exiting the housing 102. The drive shaft 190 is supported within the housing 102, such as the drive shaft housing 104, via a bearing element 194, such that there is no radial load on the drive shaft 190. One example of the bearing element 194 includes one or more alignment bushings. Another example of the bearing element 194 is a roller bearing.

In some embodiments, the radial piston device 100 includes an apparatus for monitoring temperature and/or pressure within the housing 102. Such a monitoring apparatus may be arranged at a number of different locations. The radial piston device 100 may include a case drain that is connected to any number of interior chambers of the housing 102.

Figure 5:
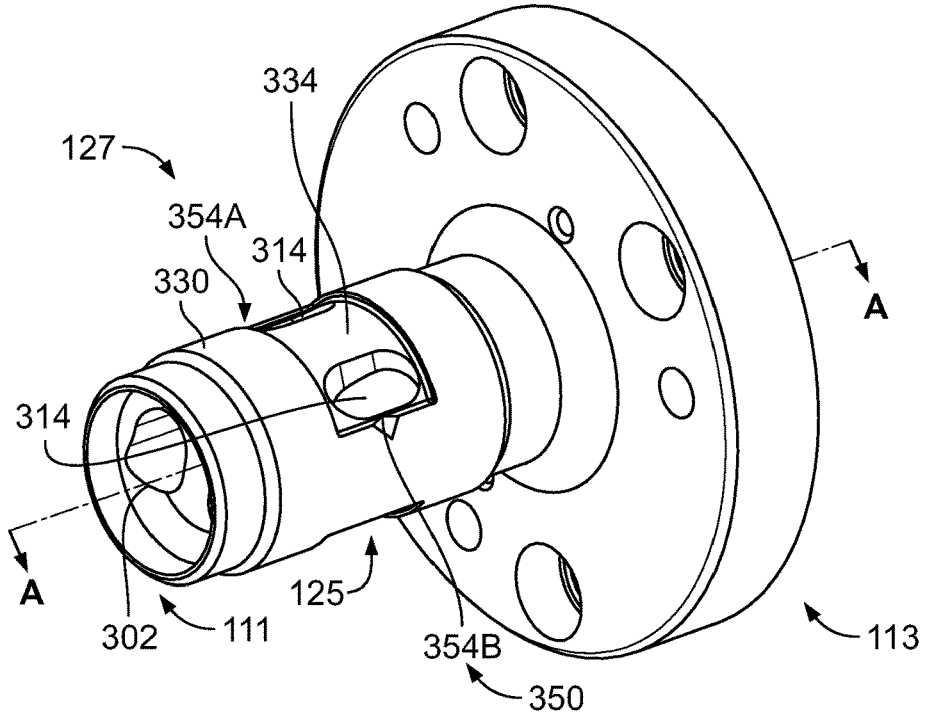
FIG. 5 is a top perspective view of an example pintle.
Figure 6:
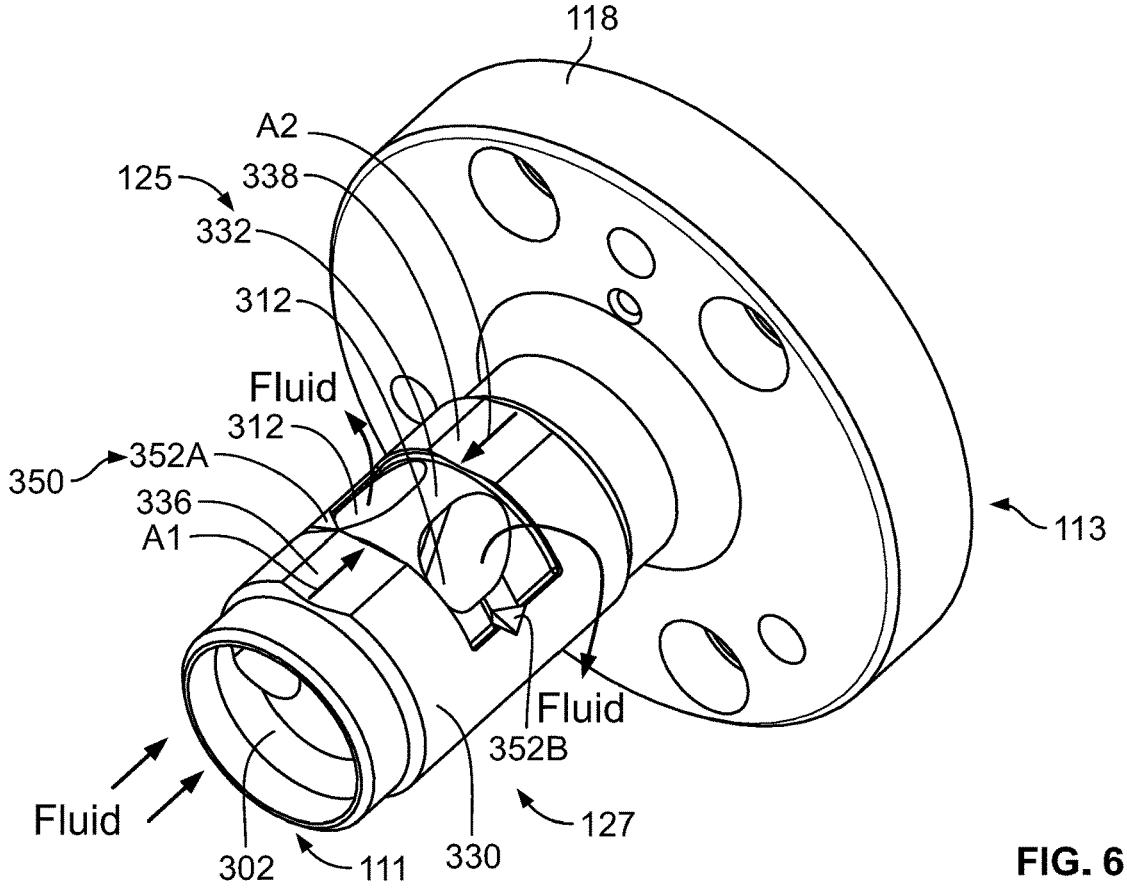
FIG. 6 is a bottom perspective view of the pintle of FIG. 5
Figure 7:
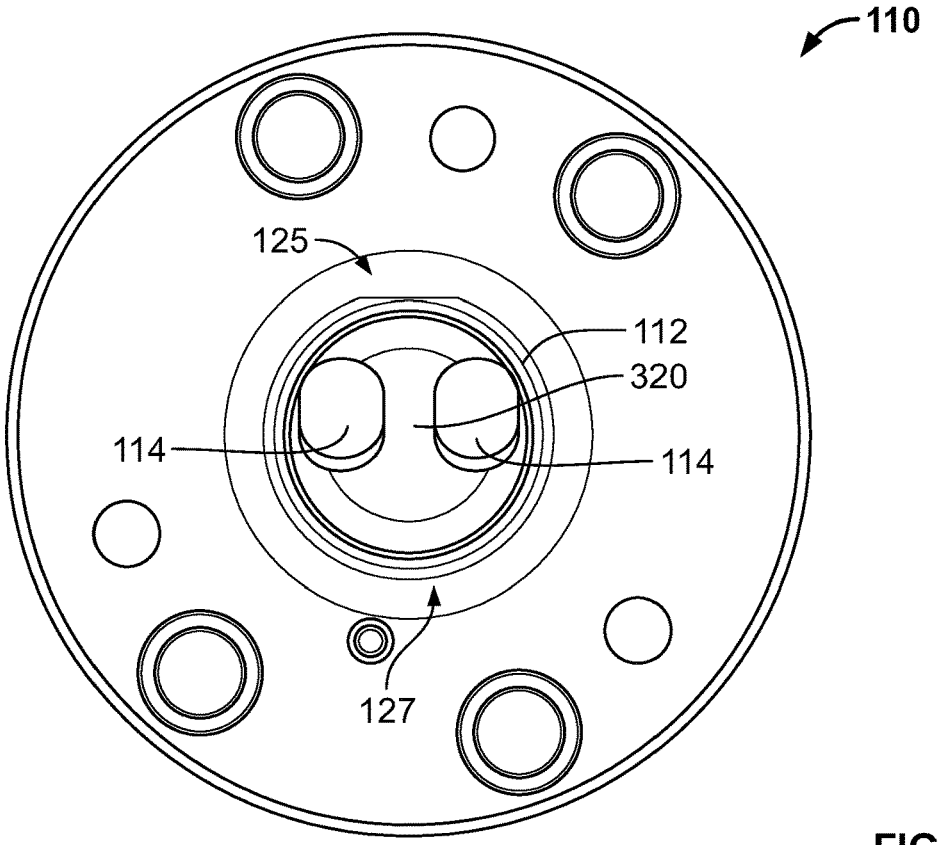
FIG. 7 is a front view of the pintle of FIG. 5.
Figure 8:
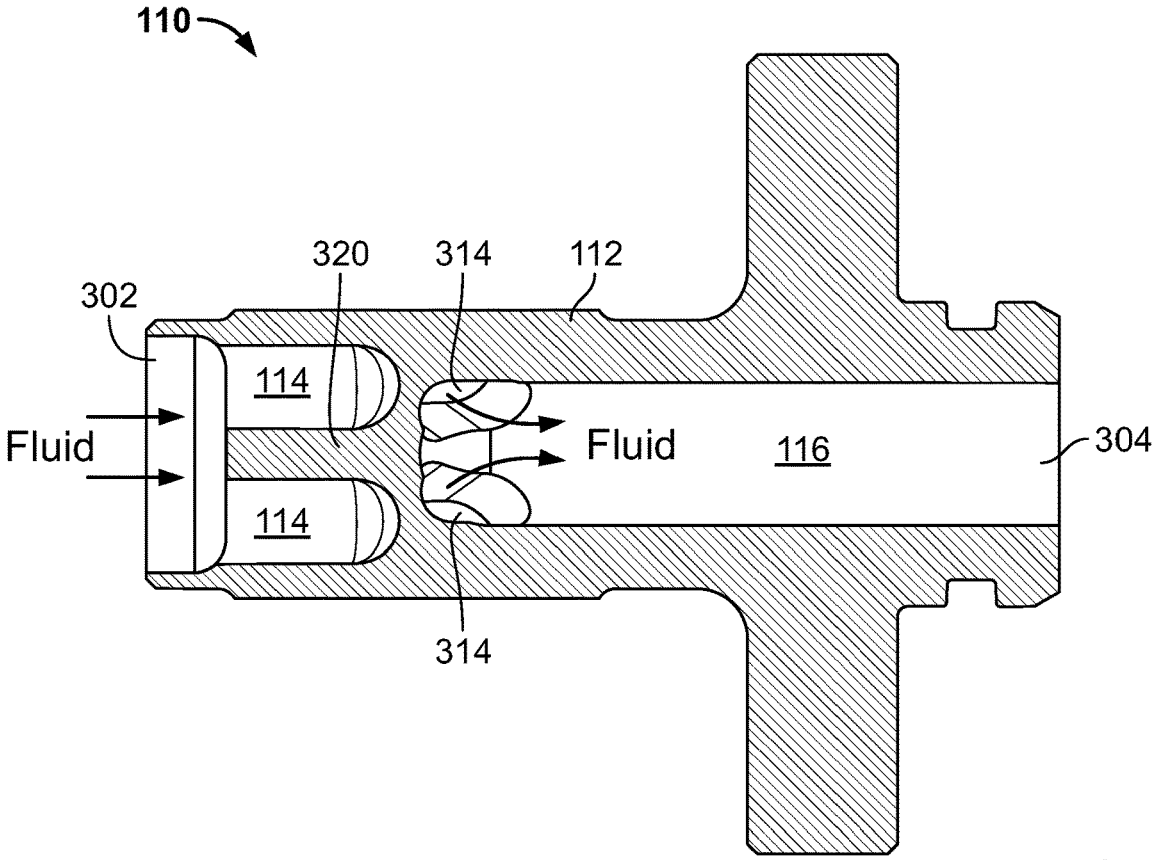
FIG. 8 is a side cross sectional view of the pintle, taken along line A-A of FIG. 5.
Figure 9A:
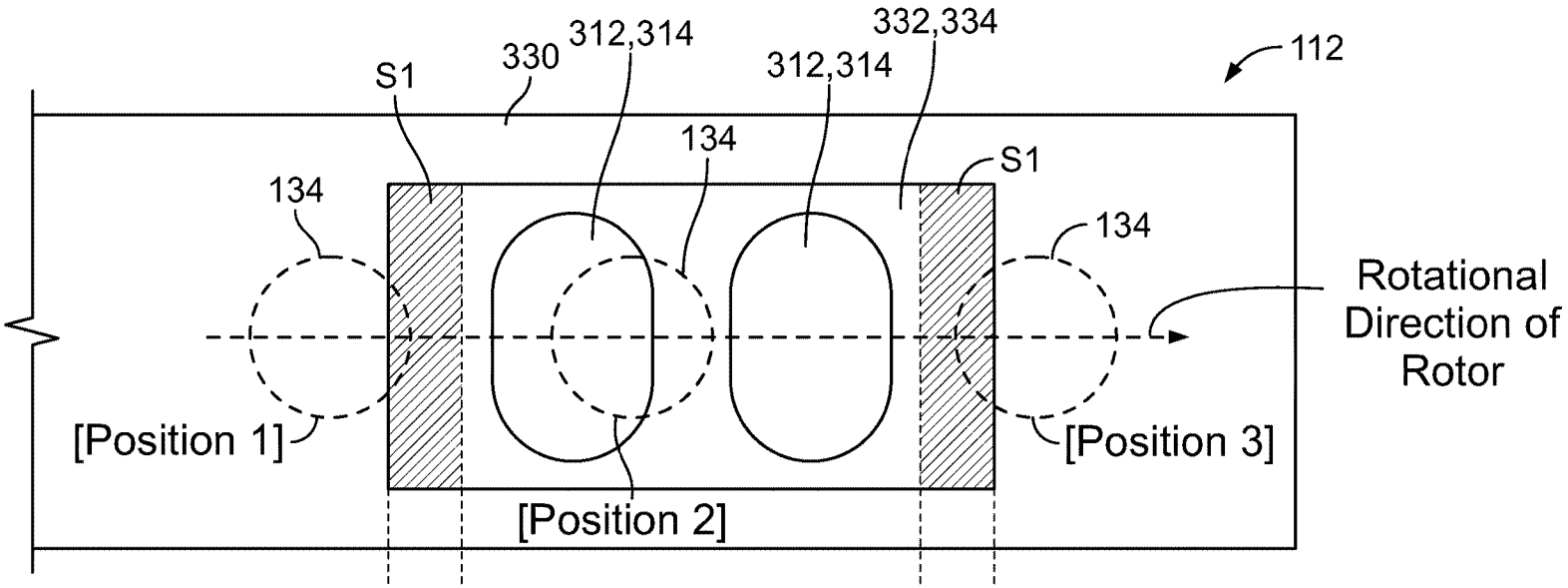
FIG. 9A illustrates an interaction between a pintle shaft and a rotor without timing recesses.
Figure 9B:
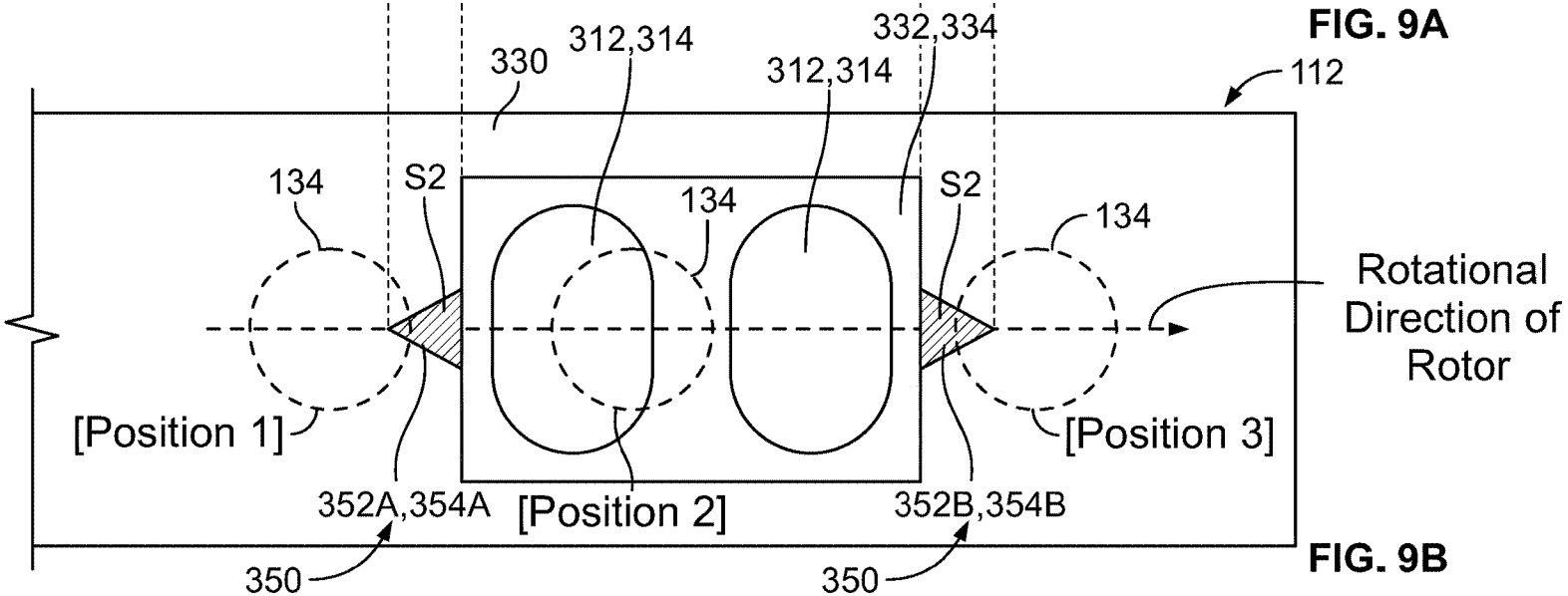
FIG. 9B illustrates an interaction between the pintle shaft and the rotor with timing recesses.

Referring to FIGS. 5-8, 9A, and 9B, an example of the pintle 110 is further described. In particular, FIG. 5 is a top perspective view of the pintle 110, and FIG. 6 is a bottom perspective view of the pintle 110. FIG. 7 is a front view of the pintle 110, and FIG. 8 is a side cross sectional view of the pintle 110, taken along line A-A of FIG. 5. FIG. 9A illustrates an interaction between the pintle shaft 112 and the rotor 130 without timing recesses, and FIG. 9B illustrates an interaction between the pintle shaft 112 and the rotor 130 with timing recesses.

In some examples, the pintle 110 includes a pintle wall 320 configured to divide either or both of the pintle inlet channel 114 and the pintle outlet channel 116 into a plurality of sections. In the illustrated example of FIGS. 7 and 8, the pintle wall 320 extends at least partially along the pintle inlet channel 114 and separates the pintle inlet channel 114 into two sections. In the illustrated example, the rotor inlet communication port 312 has two openings corresponding to the two sections of pintle inlet channel 114, respectively. The pintle wall 320 can help stiffen the pintle shaft 112 over pressure difference.

The pintle 110 includes an integrated bearing surface 330 defined around the pintle shaft 112 and configured to provide a surface against which the rotor 130 rotates. In some examples, the integrated bearing surface 330 is formed on the pintle shaft 112 to surround the rotor inlet communication port 312 and the rotor outlet communication port 314. The integrated bearing surface 330 is formed in a single piece or structure which functions as both a bearing surface and a sealing land. For example, the integrated bearing surface 330 provides a journal bearing and a sealing land. Accordingly, the integrated bearing surface 330 provides hydrodynamic bearings for the rotor 130, and eliminates additional bearing elements and shortens the axial length of the pintle shaft 112, thereby reducing bending moment on the pintle shaft.

Referring to FIGS. 5 and 6, the pintle 110 includes an inlet recess 332 to facilitate fluid flow from the rotor inlet communication port 312 to the rotor 130 (e.g., the rotor fluid port 134 of the rotor 130) therethrough. In some examples, the inlet recess 332 is depressed from the integrated bearing surface 330, and the rotor inlet communication port 312 is defined on the inlet recess 332. As the rotor fluid port 134 of the rotor 130 becomes in fluid communication with the inlet recess 332, hydraulic fluid can flow from the rotor inlet communication port 312 of the pintle 110 to the rotor fluid port 134 of the rotor 130 through the inlet recess 332 of the pintle 110.

Similarly, the pintle 110 includes an outlet recess 334 to facilitate fluid flow from the rotor 130 (e.g. the rotor fluid port 134 of the rotor 130) to the rotor outlet communication port 314 through the outlet recess 334. In some examples, the outlet recess 334 is depressed from the integrated bearing surface 330, and the rotor outlet communication port 314 is defined on the outlet recess 334. As the rotor fluid port 134 of the rotor 130 becomes in fluid communication with the outlet recess 334, hydraulic fluid can flow from the rotor fluid port 134 of the rotor 130 to the rotor outlet communication port 314 of the pintle 110 through the outlet recess 334 of the pintle 110.

The inlet recess 332 and the outlet recess 334 can be formed in various ways. In one example, the inlet recess 332 and the outlet recess 334 can be formed by electrical discharge machining (EDM). In other examples, the recesses 332 and 334 can be made by other machining processes.

Referring to FIG. 6, the pintle 110 includes one or more lubrication grooves. The lubrication grooves are configured to feed hydraulic fluid for lubricating the integrated bearing surface 330. The lubrication grooves can be defined on the integrated bearing surface. The lubrication grooves can be defined on either or both of an inlet side 125 of the pintle shaft 112 and an outlet side 127 of the pintle shaft 112.

In some examples, the pintle 110 includes a first pintle lubrication groove 336 and a second pintle lubrication groove 338.

The first pintle lubrication groove 336 is defined on the integrated bearing surface 330 to provide lubrication between the pintle shaft 112 and the rotor 130. In some examples, the first pintle lubrication groove 336 is defined between the pintle inlet end 111 and the inlet recess 332 such that, when the rotor 130 is mounted around the pintle shaft 112, the first pintle lubrication groove 336 cooperates with the rotor 130 to provide a fluid passage over the exterior of the pintle shaft 112 between the first pintle end 111 and the rotor inlet communication port 312 (or the inlet recess 332) of the pintle 110. As the side of the first pintle end 111 has a slightly higher pressure than the side of the inlet recess 332, the hydraulic fluid can flow from the first pintle end 111 toward the inlet recess 332 of the pintle 110 over the first pintle lubrication groove 336, as indicated arrow A1. The fluid that enters the first pintle lubrication groove 336 can lubricate the interface between the exterior of pintle shaft 112 and the inner diameter (ID) of the rotor 130 as the rotor 130 rotates relative to the pintle shaft 112. In some examples, the first pintle lubrication groove 336 is provided by a groove or notch formed on the integrated bearing surface 330. In other examples, the first pintle lubrication groove 336 is provided by a flat surface formed on the integrated bearing surface 330.

The second pintle lubrication groove 338 is defined on the integrated bearing surface 330 to provide lubrication between the pintle shaft 112 and the rotor 130. In some examples, the second pintle lubrication groove 338 is defined between the inlet recess 332 and the pintle outlet end 113 (e.g., the mounting flange 118), such that, when the rotor 130 is mounted around the pintle shaft 112, the second pintle lubrication groove 338 cooperates with the rotor 130 to provide a fluid passage over the exterior of the pintle shaft 112 between the second pintle end 113 and the rotor inlet communication port 312 (or the inlet recess 332) of the pintle 110. As the pressure at the side (i.e., the inlet side) of the inlet recess 332 is smaller than the pressure of the other side (i.e., the side adjacent the mounting flange 118, which is thus the case side), the hydraulic fluid can flow from the pintle outlet end 113 (i.e., the side of the mounting flange 118) toward the inlet recess 332 of the pintle 110 over the second pintle lubrication groove 338. As indicated in arrow A2, the fluid that runs on the second pintle lubrication groove 338 can lubricate the interface between the exterior of pintle shaft 112 and the inner diameter of the rotor 130 as the rotor 130 rotates relative to the pintle shaft 112. The second pintle lubrication groove can also reduce leakage from the case side to the inlet side. In some examples, the second pintle lubrication groove 338 is provided by a groove or notch formed on the integrated bearing surface 330. In other examples, the second pintle lubrication groove 338 is provided by a flat surface formed on the integrated bearing surface 330.

Although the first and second pintle lubrication grooves are provided on the inlet side 125 of the pintle shaft 112 in the illustrated example, such lubrication grooves can be alternatively or additionally provided on the outlet side 127 of the pintle shaft 112.

With continued reference to FIGS. 5 and 6, the pintle 110 includes one or more timing recesses 350 configured to adjust timing of fluid communication between the pintle shaft 112 and the rotor 130 as the rotor 130 rotates relative to the pintle shaft 112. The timing recesses 350 are configured to extend or maintain duration of fluid communication between the pintle shaft 112 and the rotor 130 without exposing as much inner diameter of the rotor 130 to fluid pressure exiting the pintle shaft 112.

As shown in FIGS. 5-7, the pintle shaft 112 has an inlet side 125 (i.e., a side adjacent the rotor inlet communication port 312) and an opposite outlet side 127 (i.e., a side adjacent the rotor outlet communication port 314). Because the second pintle end 113 is fixed to the housing 102 with the mounting flange 118 and the first pintle end 111 is unsupported, the pintle shaft 112 operates just as a cantilever along the pintle axis $A_P$. Fluid entering the cylinders 132 of the rotor 130 through the rotor inlet communication port 312 from the pintle inlet channel 114 has a lower pressure than a fluid discharging from the cylinders 132 of the rotor 130 to the pintle outlet channel 116 through the rotor outlet communication port 314. Thus, a pressure load on the outlet side 127 of the pintle shaft 112 is greater than a pressure load on the inlet side 125 of the pintle shaft 112. This pressure difference causes an unbalanced load to be applied to the pintle shaft 112 which causes the pintle shaft 112 to deflect in a curvature along its length with maximum deflection at the free end and no or minimal deflection at the fixed base end of the pintle shaft 112. The curvature of the pintle shaft 112 can cause misalignment with the rotor 130, preventing the rotor 130 from rotating about the pintle shaft 112 as designed. Further, the pressure difference can lift up the rotor 130 from the pintle shaft 112 and thus increase a gap between the pintle shaft 112 and the rotor 130 at the outlet side 127 of the pintle shaft 112. This may cause leakage of fluid.

Such pressure load on the inlet side 125 or the outlet side 127 of the pintle shaft 112 increases as the surface area of the inner diameter of the rotor 130 that is exposed to hydraulic fluid passing through the rotor inlet communication port 312 or the rotor outlet communication port 314 becomes larger. Therefore, pressure load on the inlet side 125 or the outlet side 127 of the pintle shaft 112 decreases as the amount of hydraulic fluid that contacts the inner diameter of the rotor 130 decreases. As described herein, the timing recesses can help reduce the amount of hydraulic fluid that contacts the inner diameter of the rotor.

As schematically depicted in FIG. 9B, the timing recesses 350 are arranged to maintain duration of fluid communication between the rotor inlet communication port 312 (or the rotor outlet communication port 314) of the pintle shaft 112 and the rotor fluid port 134 of the rotor 130, while reducing the area of the inner diameter of the rotor 130 that is exposed to the hydraulic fluid coming from the rotor inlet communication port 312 of the pintle shaft 112 or discharging from the rotor fluid port 134 of the rotor 130. In contrast, FIG. 9A illustrates the interaction between the rotor inlet communication port 312 (or the rotor outlet communication port 314) of the pintle shaft 112 and the rotor fluid port 134 of the rotor 130. For brevity, only one of the rotor fluid ports 134 of the rotor 130 is illustrated. In FIG. 9A, as the rotor 130 rotates relative to the pintle shaft 112, the rotor fluid port 134 of the rotor 130 gradually changes its relative position from Position 1 to Position 2, and then to Position 3, by way of example. As the rotor 130 rotates, the rotor fluid port 134 becomes in fluid communication with the rotor inlet communication port 312 (or the rotor outlet communication port 314) through the inlet recess 332 (or the outlet recess 334) in all of Positions 1, 2 and 3.

In FIG. 9B, when the rotor fluid port 134 is arranged at or adjacent Positions 1 and 3, the rotor fluid port 134 is in fluid communication with the rotor inlet communication port 312 (or the rotor outlet communication port 314) through the timing recess 350 that is connected to the inlet recess 332 (or the outlet recess 334). As seen in FIGS. 9A and 9B, the timings at which the rotor fluid port 134 becomes in fluid communication with the rotor inlet communication port 312 (or the rotor outlet communication port 314) or ceases to be in fluid communication with the rotor inlet communication port 312 (or the rotor outlet communication port 314) remain the same. However, the area S1 of hydraulic fluid that is exposed to the inner diameter of the rotor 130 in the example of FIG. 9A (without the timing recesses) is larger than the area S2 of hydraulic fluid that is exposed to the inner diameter of the rotor 130 in the example of FIG. 9B (with the timing recesses). As such, the timing recesses 350 operates to maintain duration of fluid communication between the pintle shaft 112 and the rotor 130 while reducing the pressure load on the pintle shaft 112.

In the illustrated example, the timing recesses 350 includes one or more inlet timing recesses 352 formed on the pintle shaft 112 and abutted to the inlet recess 332 so as to be in fluid communication with the rotor inlet communication port 312 through the inlet recess 332. In some examples, the inlet timing recesses 352 include a first inlet timing recess 352A and a second inlet timing recess 352B, which are arranged and connected to the opposite sides of the inlet recess 332. Further, the timing recesses 350 includes one or more outlet timing recesses 354 formed on the pintle shaft 112 and abutted to the outlet recess 334 so as to be in fluid communication with the rotor outlet communication port 314 through the outlet recess 334. In some examples, the outlet timing recesses 354 include a first outlet timing recess 354A and a second outlet timing recess 354B, which are arranged and connected to the opposite sides of the outlet recess 334.

In some examples, the timing recesses 350 are formed as notches extending from the inlet recess 332 and the outlet recess 334. Other shapes for the timing recesses are also possible in other examples. The timing recesses 350 can have different sizes to the extent that the width of the timing recesses 350 is smaller than the width of the inlet recess 332 or the outlet recess 334. In some examples, the area of each timing recess 350 is smaller than the area of each rotor fluid port 134 of the rotor 130. In other examples, the area of each timing recess 350 is equal to or greater than the area of each rotor fluid port 134 of the rotor 130.

In other examples, the timing recesses 350 can in effect function to expedite fluid communication between the rotor inlet communication port 312 (or the rotor outlet communication port 314) of the pintle shaft 112 and the rotor fluid port 134 of the rotor 130 as the rotor 130 rotates relative to the pintle shaft 112. In this configuration, the timing recesses 350 operates to shorten pre-compression and de-compression times.

Figure 10:
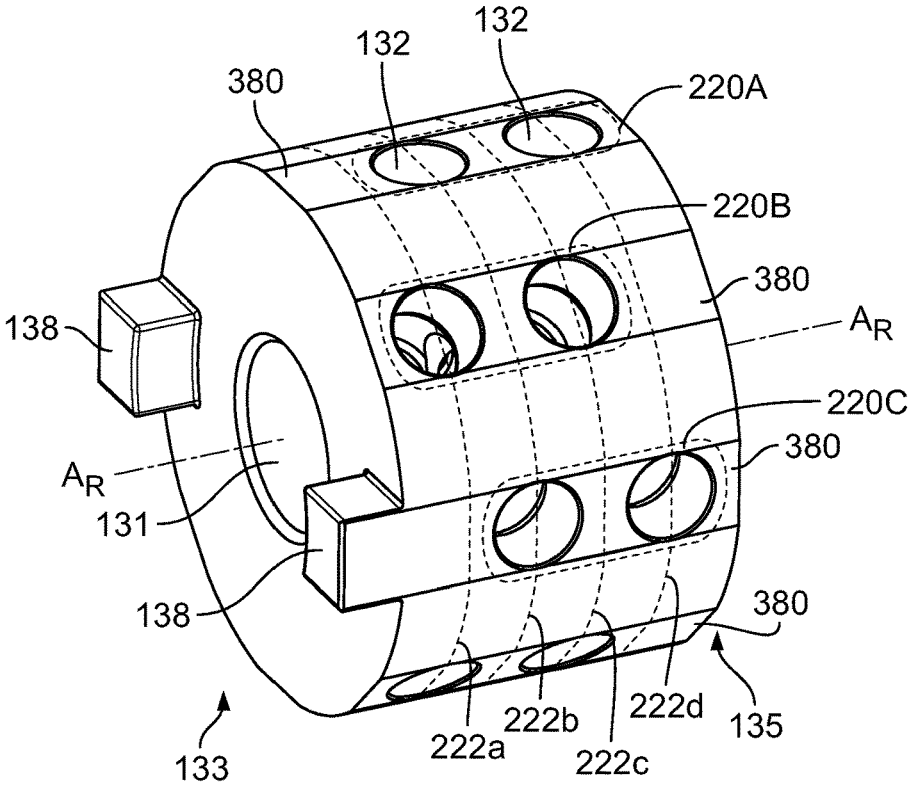
FIG. 10 is a perspective view of an example rotor.

Referring to FIGS. 10 and 11, an example of the rotor 130 is further described. In particular, FIG. 10 is a perspective view of an example rotor 130, and FIG. 11 is a cross sectional view of the rotor 130 of FIG. 10.

As shown in FIG. 10, the radial cylinders 132 are defined in the rotor 130 to respectively receive the pistons 150. In some examples, the cylinders 132 are grouped into a plurality of pairs that are arranged around the rotor 130. Two cylinders 132 in each pair are located adjacent each other along a linear axis parallel to the rotor axis $A_R$. The pairs of linearly-aligned cylinders 132 and the corresponding pistons 150 can also be referred to herein as cylinder sets and piston sets, respectively.

Each of the cylinder pairs or sets 220 (such as 220A, 220B, and 220C in FIG. 10) is offset from an adjacent cylinder set, such that four rows 222*a*, 222*b*, 222*c* and 222*d* are present on the rotor 130. The rows 222*a*, 222*b*, 222*c* and 222*d* extend in a circumferential direction about the rotor and are axially offset from one another, so as to transverse the cylinders, respectively. In general, axial offsetting the rows of cylinder sets, and of piston sets therein, around the rotor 130 allows the overall size of the rotor 130 (and therefore the device 100) to be reduced. Additionally, the offsetting of the cylinder/piston rows balances the thrust loads on the rotor that are generated due to contact between the piston ring 170 and the pistons 150.

A minimum of two rows 222 are necessary to balance the thrust loads on the piston ring. In other examples, other numbers of rows may be utilized. In this example, four piston rows 222*a*, 222*b*, 222*c* and 222*d* are utilized.

In some examples, the rotor 130 includes an even number of cylinders 132 (and an even number of pistons accordingly) to provide balance in operation. The even number of cylinders 132 can be equally spaced around the rotor 130. For example, the rotor 130 includes eight (8) cylinder pairs 220 spaced equally therearound, thereby providing 16 cylinders in total. In other examples, other even numbers of cylinders can be provided in the rotor.

Referring to FIG. 11, each of the rotor fluid ports 134 is in fluidic communication with both cylinders 132 of each cylinder set 220. This helps reduce the high pressure footprint between the rotor 130 and pintle 110 in order to achieve a more balanced radial load on the pintle journals.

In some examples, the rotor fluid port 134 can be connected to one of the cylinders 132 of a set 220 through a first rotor port channel 372, and connected to the other cylinder 132 of the set 220 through a second rotor port channel 374. The first rotor port channel 372 and the second rotor port channel 374 can be formed by cross-drilling. For example, the first rotor port channel 372 is formed by drilling the inner diameter (ID) of the rotor 130 toward one of the cylinders in a set. In this process, a first port is formed, which extends to the one of the cylinders through the first rotor port channel 372. In some examples, the first rotor port channel 372 can formed at an angle from the starting hole (i.e., the first port) to the cylinder.

Then, the second rotor port channel 374 is drilled from the inner diameter (ID) of the rotor 130 toward the other cylinder in the set. In this process, a second port is formed, which extends to the other cylinder through the second rotor port channel 374. In some examples, the second rotor port channel 374 can be formed at an angle from the starting hole (i.e., the second port) to the cylinder. The first port and the second port can be at least partially overlapped to define the rotor fluid port 134. The first rotor port channel 372 and the second rotor port channel 374 are oriented to cross over each other.

Referring again to FIG. 10, the rotor 130 may include flat faces 380 adjacent the cylinder sets 220. In some examples, the flat faces 380 axially extend on the outer surface of the rotor so as to include the openings of the cylinder sets 220. The flat faces 380 can be formed in various processes, such as milling. The flat faces 380 can be used as reference surfaces, which are used for precise formation of the cylinders 132 in the rotor 130.

Referring still to FIGS. 10 and 11, the rotor 130 includes one or more rotor teeth 138 (also referred to herein as engagement elements, tangs, or keys) to engage a coupling device 200. In some examples, the rotor teeth 138 are provided on the inlet end 133 of the rotor 130. In this example, two rotor teeth 138 are provided to engage the coupling device 200 at an angle of about 90 degrees from two shaft teeth 198 (FIG. 14) of the drive shaft 190.

Figure 12:
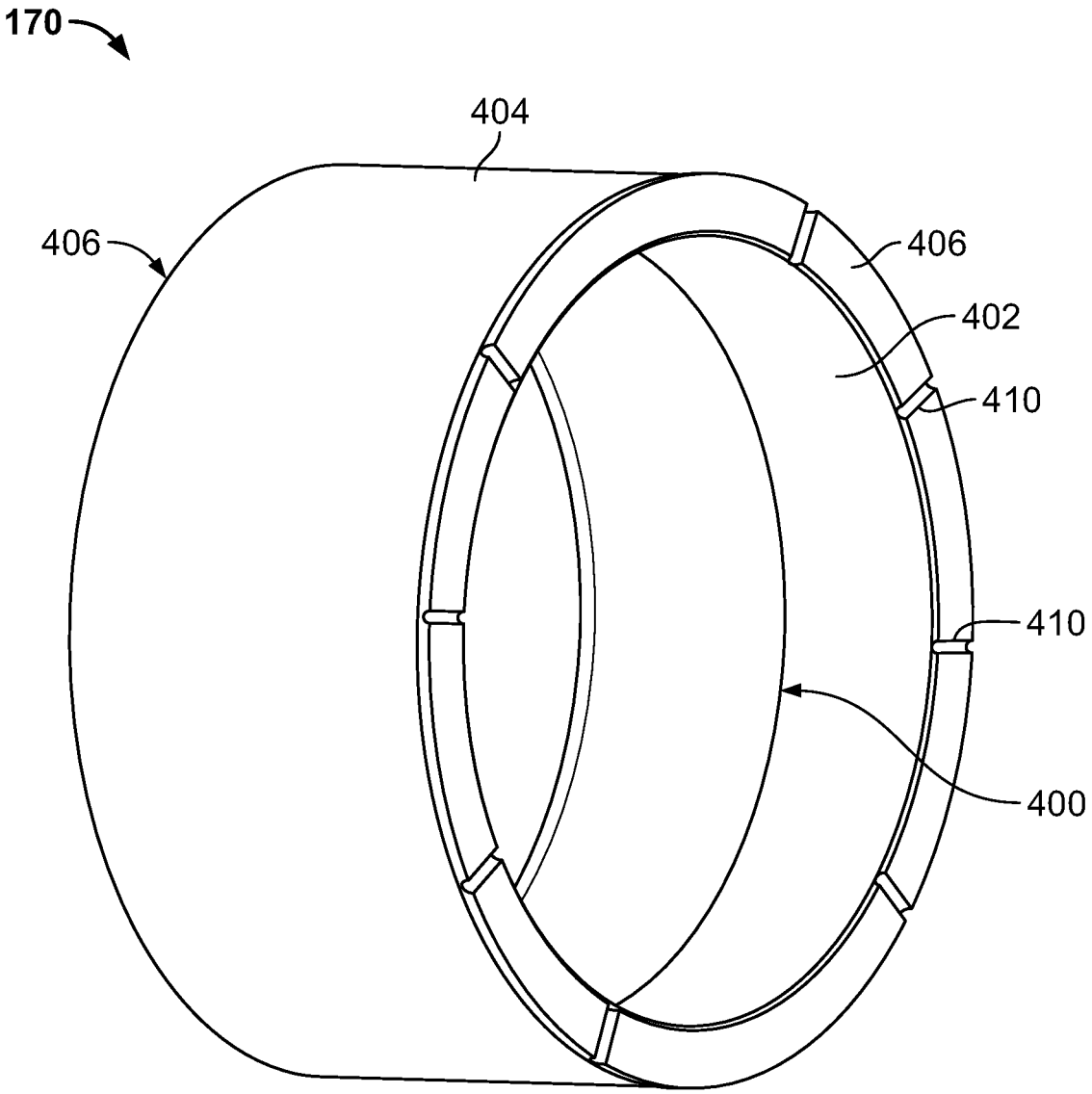
FIG. 12 is a perspective view of an example piston ring.
Figure 13A:
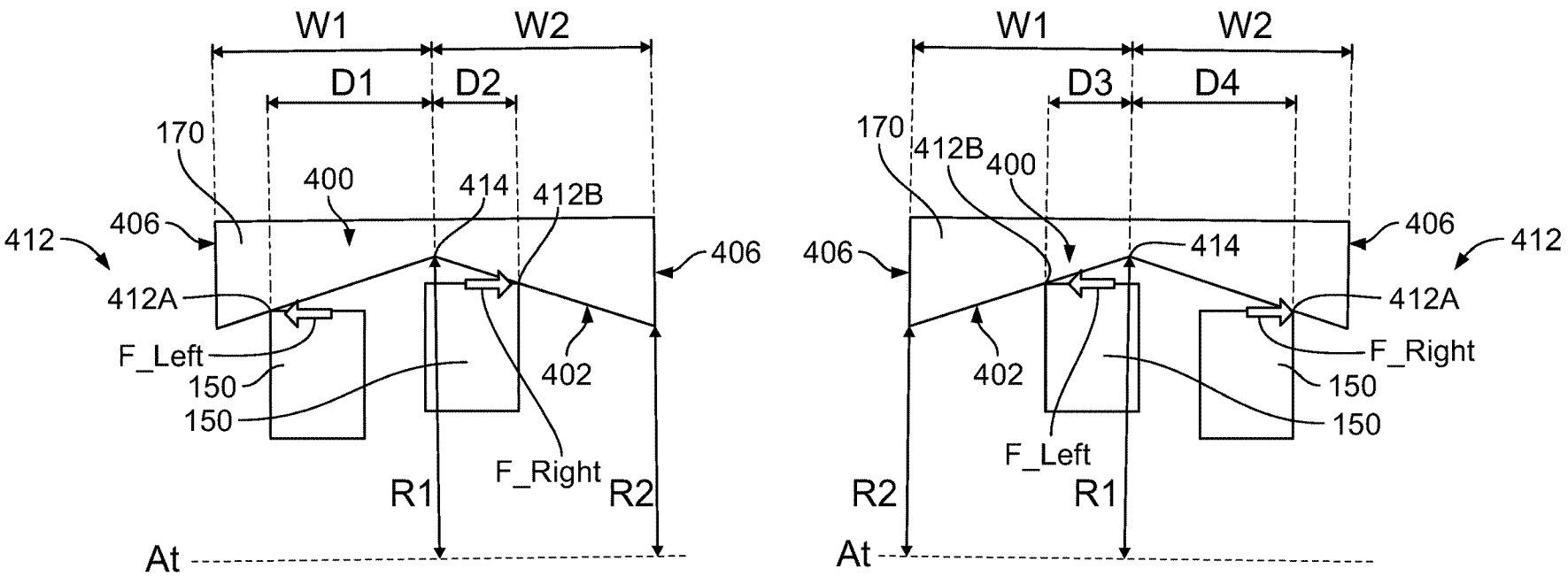
FIG. 13A is a schematic, partial cross sectional view of the piston ring of FIG. 12.
Figure 13B:
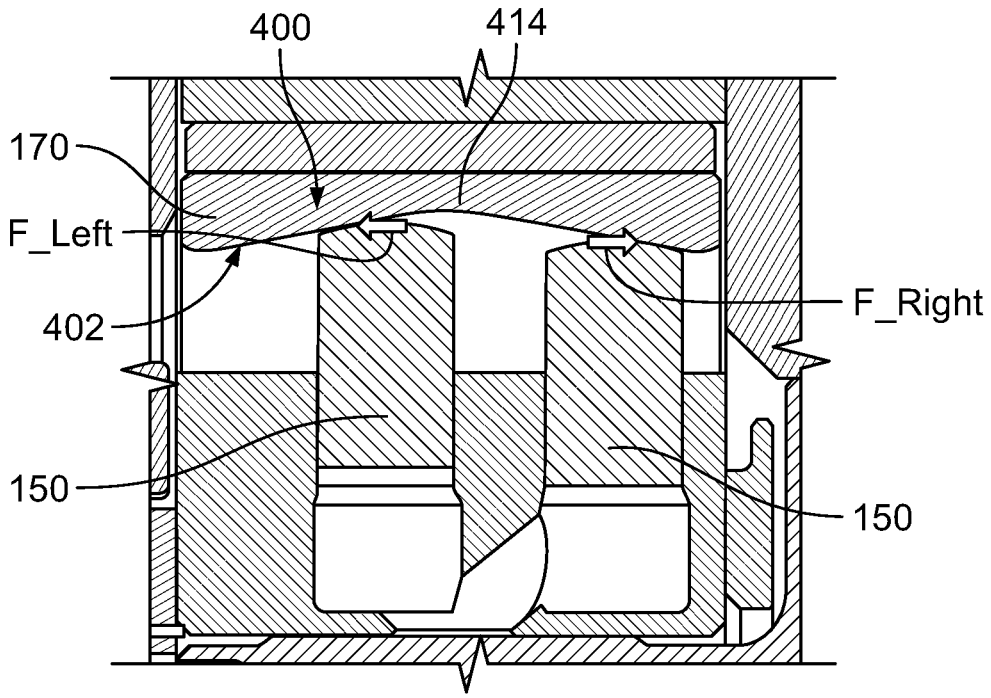
FIG. 13B is a schematic, partial cross sectional view of the piston ring of FIG. 12.

Referring to FIGS. 12-13, an example of the piston ring 170 is further described. In particular, FIG. 12 is a perspective view of an example piston ring 170, and FIGS. 13A and 13B are schematic, partial cross sectional views of the piston ring 170 of FIG. 12.

In some examples, the piston ring 170 has a V-shape configuration 400. The piston ring 170 has an inner diameter or surface 402 and an outer diameter or surface 404, which axially extend between opposite axial end faces 406. As illustrated in FIG. 13, the V-shape configuration 400 is formed on the inner diameter 402 of the piston ring 170. The V-shape configuration 400 enhances a balance as the rotor rotates and the reciprocating pistons contact the inner surface of the piston ring, and reduces wear on the pistons.

In some examples, the inner surface 402 has a first radius R1 (or a first diameter) measured around the piston ring axis $A_T$ at a fillet point 414 of the piston ring 170, and a second radius R2 (or a second diameter) measured around the piston ring axis $A_T$ at the ends of the width of the piston ring 170. In some examples, the fillet point 414 is located at the center of the width of the piston ring 170 (i.e., where a distance W1 between the fillet point 414 and one end face 406 is the same as a distance W2 between the fillet point 414 and the other end face 406). In other examples, the fillet point 414 is located off-centered, so that the distance W1 is different from the distance W2.

The inner surface 402 of the piston ring 170 is configured such that the first radius R1 is greater than the second radius R2. For example, the inner surface 402 is configured such that the radius of the inner surface 402 changes from the largest radius (i.e., the first radius R1) at the center of the width of the piston ring, and the smallest radius (i.e., the second radius R2) at the ends of the width of the piston ring. In some embodiments, the radius of the inner surface 402 can change gradually between the first radius R1 and the second radius R2. In other embodiments, the radius of the inner surface 402 can change discretely between the first radius R1 and the second radius R2. In yet other embodiments, the radius of the inner surface 402 can change linearly between the first radius R1 and the second radius R2. In yet other embodiments, the inner surface 402 has a curvature between the first radius R1 and the second radius R2.

As described herein, each set of pistons 150 is offset from adjacent set of pistons 150 around the rotor 130. One of the diagrams in FIG. 13A shows a position of one piston set relative to the piston ring 170, and the other diagram shows a position of an adjacent piston set relative to the piston ring 170. The V-shape configuration enables one piston of each piston set to contact the inner surface 402 of one of the halves of the V-shape configuration to generate a load on the piston ring 170 in one direction (e.g., in an axial direction parallel with the ring axis), and also enables the other piston of the same piston set to contact the inner surface 402 of the other half of the V-shape configuration to generate an equal and opposite load on the piston ring 170 in the opposite direction (e.g., in the opposite axial direction parallel with the ring axis). With these loads on the piston ring 170 in the opposite axial directions, the balance is achieved. For example, as shown in FIGS. 13A and 13B, a left piston of each piston set contacts the left portion of the V-shape configuration of the piston ring 170 and generates a load to the left ($F_{LEFT}$) on the piston ring, and a right piston of the same piston set contacts the right portion of the V-shape configuration of the piston ring 170 and generates an equal, opposite load to the right ($F_{RIGHT}$) on the piston ring.

Contact points 412 (such as 412A and 412B) at which the piston 150 contacts the inner surface 402 of the piston ring 170 are arranged away from the fillet point 414 of the V-shape configuration 400 (i.e., the position at which the first radius R1 is measured). An axial distance D1, D2, D3, or D4 between the contact points 412 and the fillet 414 can vary depending on the configurations of associated components, such as the piston ring 170, the pistons 150, and the rotor 130. In some examples, the positions of adjacent piston sets (such as shown in two diagrams in FIG. 13A) can be symmetrical. For example, the distance D1 between the contact point 412A and the fillet point 414 is identical to the distance D4 between the contact point 412A and the fillet point 414, and the distance D2 between the contact point 412B and the fillet point 414 is identical to the distance D3 between the contact point 412B and the fillet point 414. In other examples, at least two of the distances D1-D4 are configured to be different.

In some examples, the distance D1-D4 between the contact point 412 and the fillet 414 ranges between about ⅛ and about ⅞ of the distance W1 or W2 between the fillet point 414 and the end face 406. In other examples, the distance D1-D4 between the contact point 412 and the fillet 414 ranges between about ⅙ and about ⅚ of the distance W1 or W2 between the fillet point 414 and the end face 406. In yet other examples, the distance D1-D4 between the contact point 412 and the fillet 414 ranges between about ¼ and about ¾ of the distance W1 or W2 between the fillet point 414 and the end face 406.

In other examples, a radius measure around the piston ring axis $A_T$ at one end of the width of the piston ring 170 is different from a radius measure around the piston ring axis $A_T$ at the other end of the width of the piston ring 170. These radii at the opposite axial ends of the piston ring 170 are smaller than the first radius R1.

Referring again to FIG. 12, the piston ring 170 can include one or more grooves 410 formed on at least one of the axial end faces 406 and configured to provide fluid flow path therealong. The grooves 410 radially extend between the inner diameter 402 and the outer diameter 404 such that hydraulic fluid travels from the inner diameter 402 to the outer diameter 404 as the piston ring 170 rotates. In some examples, the grooves 410 can be used to reduce turbulent or laminar fluid drag. In other examples, the grooves 410 can provide lubrication, such as to improve fluid flow, reduce power loss, reduce friction, and reduce the piston ring temperature. In some examples, the grooves 410 are formed on both of the axial end faces 406. In other examples, the grooves 410 are formed on one of the axial end faces 406.

Figure 14:
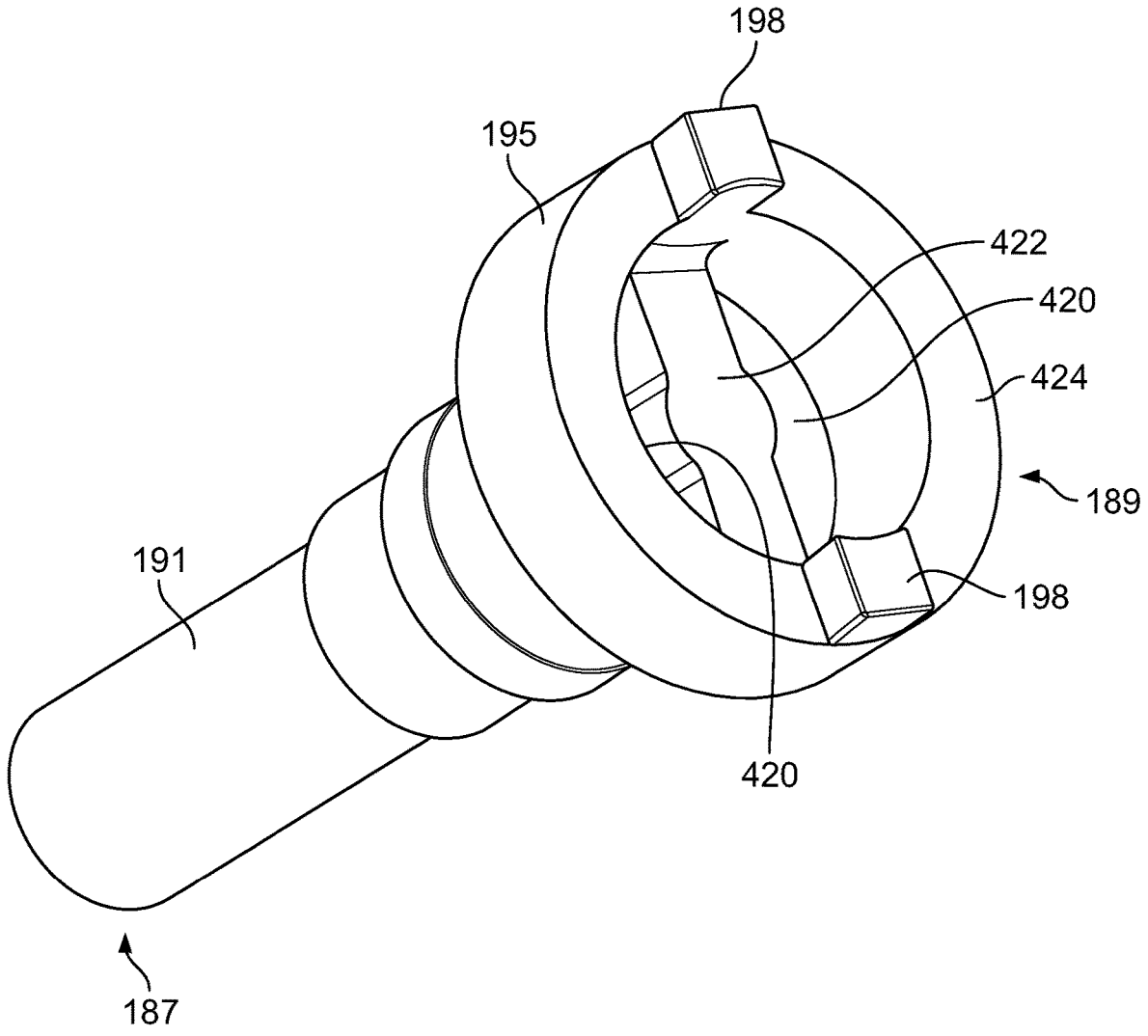
FIG. 14 is a perspective view of an example drive shaft.
Figure 15:
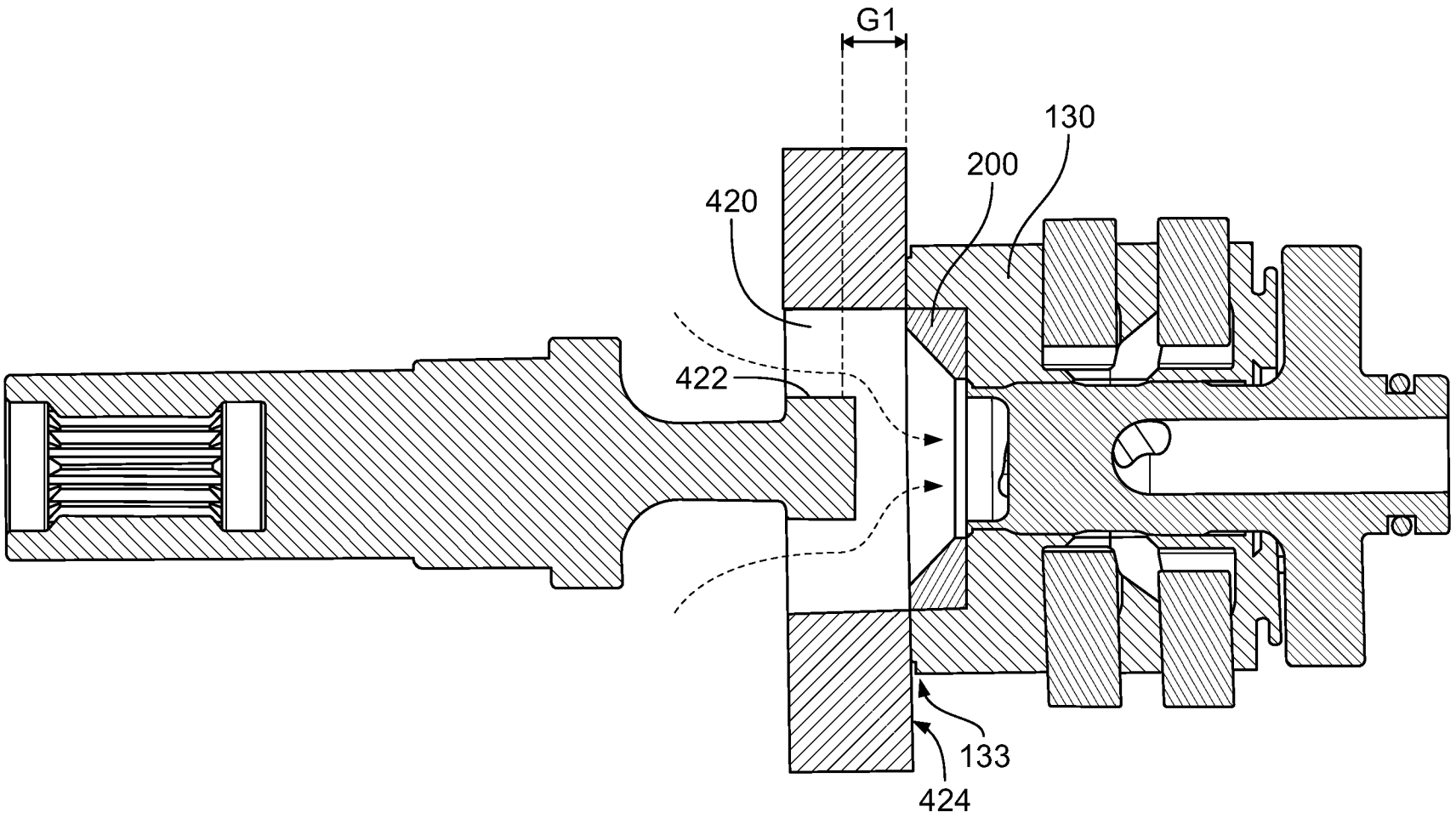
FIG. 15 is a schematic, cross sectional view of the drive shaft with some associated elements.

Referring to FIGS. 14 and 15, an example of the drive shaft 190 is further described. In particular, FIG. 14 is a perspective view of an example drive shaft 190, and FIG. 15 is a schematic, cross sectional view of the drive shaft 190 with some associated elements. FIGS. 2, 4A and 4B are also referred to in describing the drive shaft 190.

In some examples, the drive shaft 190 includes a shaft head 191, a stem 193 and a power transfer flange 195. The shaft head 191 is configured to be engaged with a driving mechanism (not shown) at the driving end 187 of the drive shaft 190 so that torque is input to the drive shaft 190 to rotate the rotor 130 when the radial piston device 100 operates as a pump. In some examples, at least a portion of the shaft head 191 can be surface hardened (e.g., carbonized) to provide a bearing surface. A power transfer flange 195 is configured to be engaged with the rotor 130. The stem 193 extends between the shaft head 191 and the power transfer flange 195. In some examples, the drive shaft 190 is located within the drive shaft housing 104 such that hydraulic fluid entering the drive shaft housing 104 via the hydraulic fluid inlet 108 flows around the stem 193 of the drive shaft 190 and into the pintle inlet channel 114 of the pintle shaft 112.

As illustrated, the power transfer flange 195 of the drive shaft 190 is coupled to the rotor 130, either directly or via a coupling device 200. The power transfer flange 195 is configured to define one or more flow passages 420 in fluid communication with the pintle inlet port 302 of the pintle shaft 112. Thus, the flow passages 420 permit the fluid to flow from the hydraulic fluid inlet 108 to the pintle inlet channel 114 of the pintle shaft 112. The flow passages 202 can allow hydraulic suction flow to pass into the center of the coupling device 200 as described below.

In some examples, the drive shaft 190 includes a crossbar 422 provided to the power transfer flange 195. The crossbar 422 can extend across the flow passage 420 defined by the power transfer flange 195. The crossbar 422 can also be connected to the stem 193 of the drive shaft 190. In some embodiments, the crossbar 422 is arranged to be offset from a base 424 of the power transfer flange 195 which is engaged with, or abutted with, the inlet end 133 of the rotor 130. As shown in FIG. 15, a gap G is defined by the offset between the crossbar 422 and the base 424 of the power transfer flange 195. Therefore, the crossbar 422 is arranged to be offset from a face (e.g., the inlet end 133) of the rotor 130. The offset crossbar 422 promotes natural flow of hydraulic fluid into the pintle inlet channel 114 by reducing inlet pressure. The crossbar 422 can provide an increased space at the center in front of the pintle inlet port 302 of the pintle shaft 112 and thus guide fluid to naturally flow into the pintle inlet port 302 of the pintle shaft 112. As such, the offset crossbar 422 can help fluid flow into the pintle shaft 112 without increasing the axial width of the power transfer flange 195 or without other mechanisms (e.g., a funnel or cone shape element) for centralizing fluid flow before entry to the pintle shaft 112.

Figure 16:
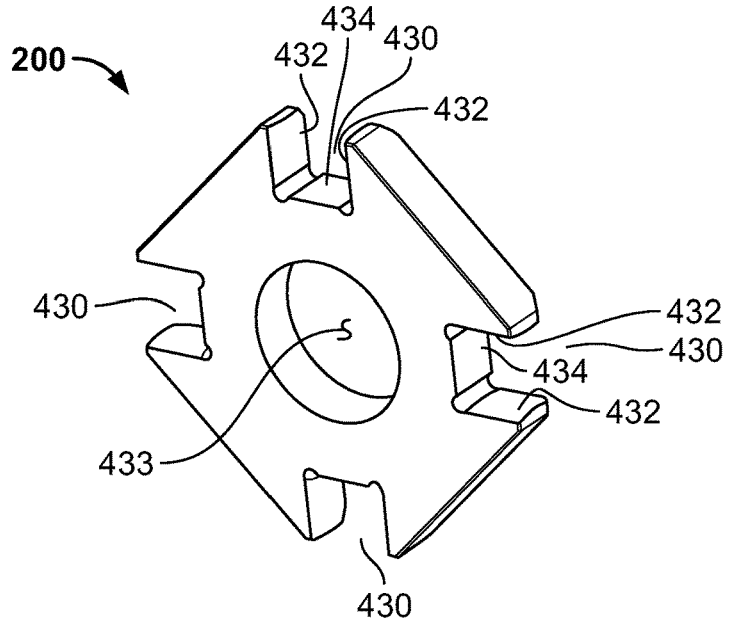
FIG. 16 is a perspective view of an example coupling element.
Figure 17:
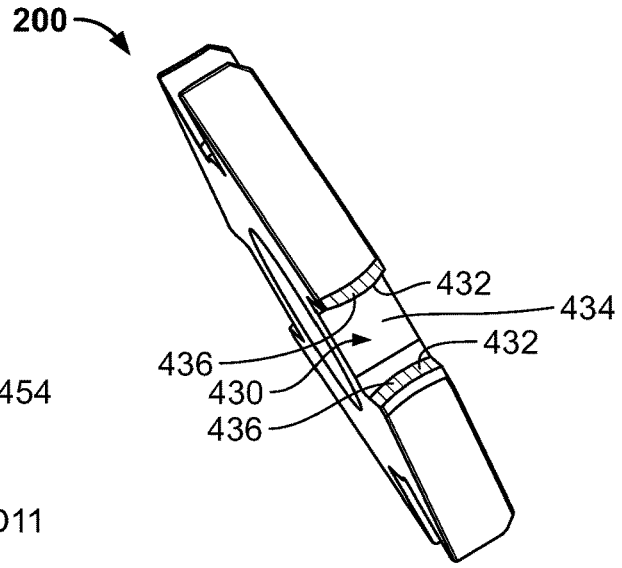
FIG. 17 is another perspective view of the coupling element of FIG. 16.

Referring to FIGS. 16 and 17, an example of the coupling element 200 is described. In particular, FIG. 16 is a perspective view of an example coupling element 200, and FIG. 17 is another perspective view of the coupling element 200 of FIG. 16. FIGS. 2, 4A, 4B, and 15 are also referred to in describing the drive shaft 190.

The coupling element 200 is disposed between the drive shaft 190 and the rotor 130 to connect the drive shaft 190 to the rotor 130 at the power transfer end 189 of the drive shaft 190. In some examples, the drive shaft 190 is connected to the inlet end of the rotor 130 at the coupling element 200. For example, the power transfer flange 195 of the drive shaft 190 may be connected to the inlet end 133 of the rotor 130 with the coupling device 200 therebetween.

As shown in FIGS. 4B and 14, in some examples, the power transfer flange 195 of the drive shaft 190 includes one or more shaft teeth 198 (also referred to herein as engagement elements, tangs, or keys) to engage the coupling device 200. In this example, two shaft teeth 198 engage the coupling device 200 at an angle of about 90 degrees from two rotor teeth 138 (FIG. 10) that also engage the coupling device 200.

Corresponding to the shaft teeth 198 and the rotor teeth 138, the coupling device 200 defines a number of recesses 430 for receiving the shaft teeth 198 and the rotor teeth 138. The coupling device 200 defines a flow passage 433 to collect the hydraulic suction flow into the pintle inlet channel 114. In some examples, the flow passage 433 may include a tapered or funneled inner surface that reduces pressure losses as the hydraulic fluid is drawn into the pintle inlet 114. In other examples, the flow passage 433 is defined with the inner surface of a consistent diameter (i.e., without such a tapered or funneled inner surface).

The coupling device 200 can be of various configurations. In some examples, the coupling device 200 is configured to be flexible so as to allow for some degree of misalignment between the rotor axis $A_R$ and a shaft axis $A_S$. One example of the coupling device 200 is an Oldham coupling. In other examples, the drive shaft 190 and rotor 130 may be directly engaged with each other, without the use of the coupling device 200.

Referring still to FIGS. 16 and 17, the recesses 430 have opposing lateral surfaces 432 and a bottom surface 434. The lateral surfaces 432 of the recesses 430 contact the shaft teeth 198 of the drive shaft 190 and the rotor teeth 138 of the rotor 130 to transfer torque from the drive shaft 190 to the rotor 130 or vice versa. In some examples, the lateral surfaces 432 of the recess 430 have curved shapes. For example, the lateral surface 432 includes a convex surface 436 (also referred to herein as a crowned surface), which raises or curves outwardly toward the opposing lateral surface 432. The crowned surface 436 improve engagement between the recesses 430 of the coupling device 200 and the shaft teeth 198 of the drive shaft 190 and between the recesses 430 of the coupling device 200 and the rotor teeth 138 of the rotor 130.

In some examples, the surfaces of the recesses can be hardened, such as by carbonization.

Although it is described in this example that the crowned surfaces are provided in the recesses of the coupling device 200, it is also possible to provide such crowned surfaces to the shaft teeth 198 of the drive shaft 190 and the rotor teeth 138 of the rotor 130. In yet other examples, such crowned surfaces are provided both to the recesses 430 of the coupling device 200, and to the shaft teeth 198 of the drive shaft 190 the rotor teeth 138 of the rotor 130.

Figure 18:
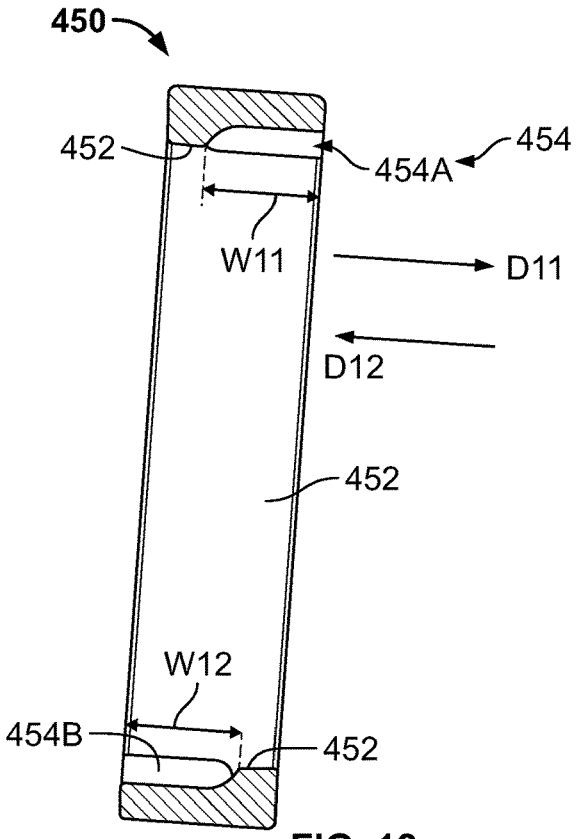
FIG. 18 is a cross sectional view of an example bearing element.
Figure 19:
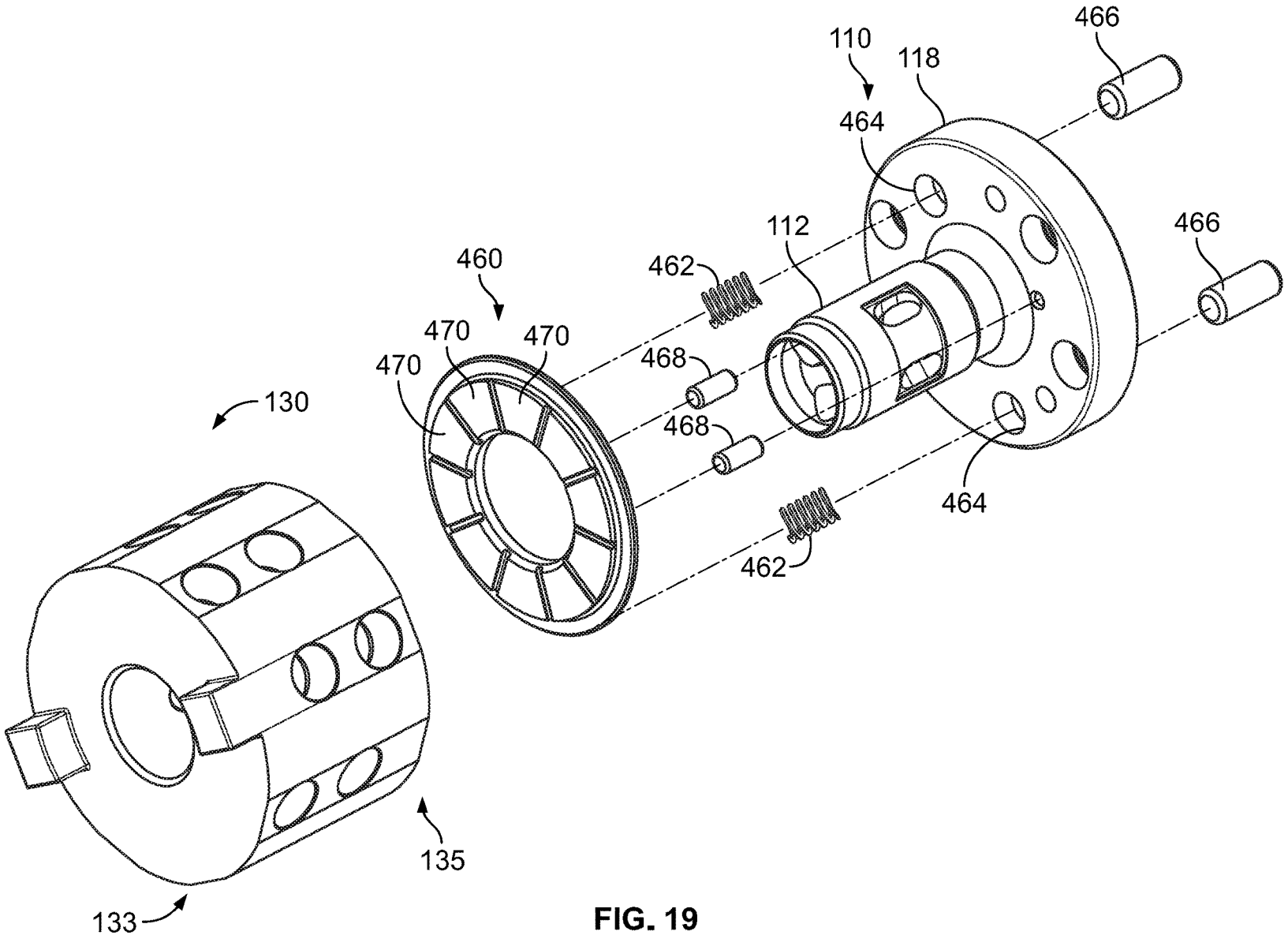
FIG. 19 is an exploded perspective view of an example thrust plate with the rotor and the pintle.
Figure 20:
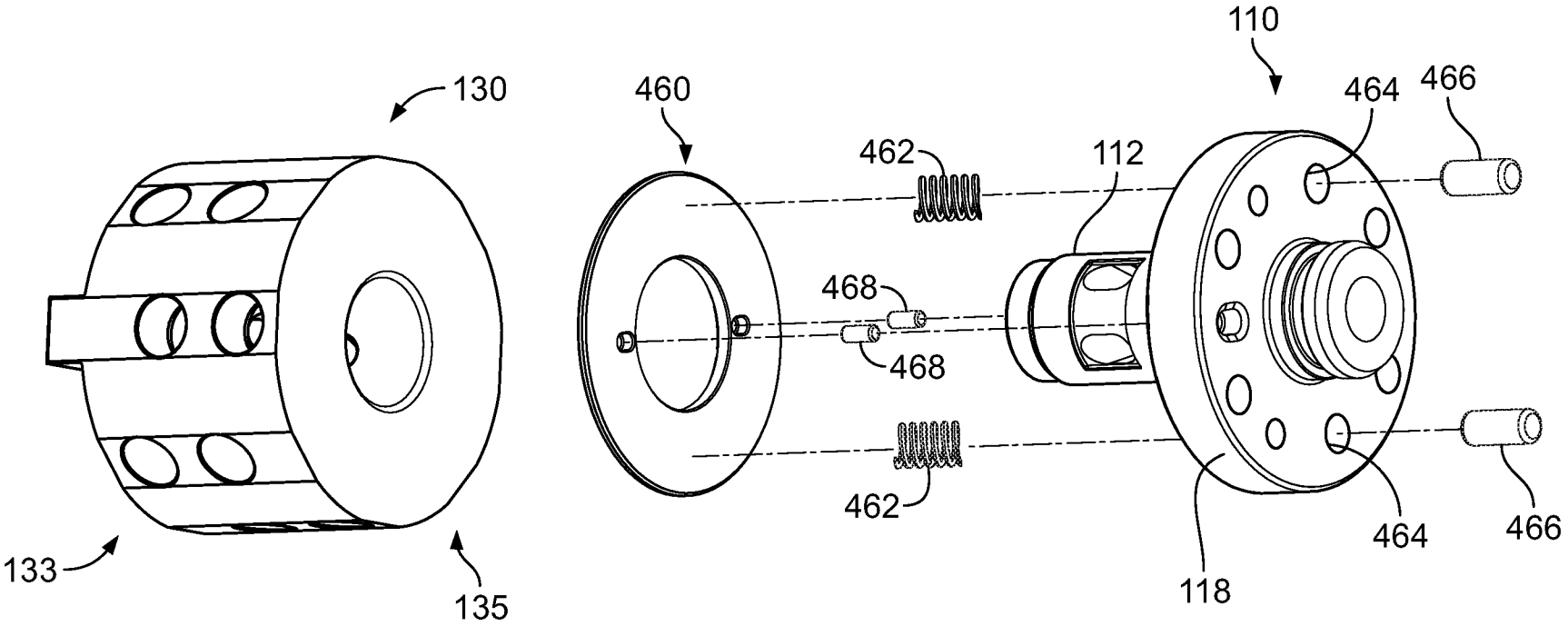
FIG. 20 is another exploded perspective view of the thrust plate with the rotor and the pintle.

Referring to FIGS. 2-4 and 18, an example bearing element 450 is described. In particular, FIG. 18 is a cross sectional view of the bearing element 450.

The bearing element 450 is disposed between an inner surface of the housing 102 and the power transfer flange 195 of the drive shaft 190, and provides an inner bearing surface 452 against which the power transfer flange 195 slides as the drive shaft 190 rotates relative to the drive shaft axis of rotation $A_S$.

The bearing element 450 can be of various types. In the illustrated example, the bearing element 450 is configured as a journal bearing. Other types are also possible in other examples.

In some examples, the bearing element 450 includes one or more grooves 454 formed on the inner bearing surface 452. As the bearing element 450 is arranged between the case side and the inlet side, one axial side of the bearing element 450 is exposed to the case pressure, and the other side is exposed to the inlet pressure, which can be lower than the case pressure. The grooves 454 provided to the bearing element 450 can help minimizing fluid flow crossing from the case side to the inlet side, thereby preventing excess leakage from the case side to the inlet side.

The grooves 454 can axially extend only a portion of the width of the bearing element 450. In the illustrated example, the bearing element 450 includes a first groove 454A and a second groove 454B. The two grooves are formed on the inner bearing surface 452 of the bearing element 450, and axially extend and are open in the opposite directions. In some examples, the first groove 454A axially extends along a portion of the width of the bearing element 450. For example, the first groove 454A is open in a first axial direction D11 and closed in a second axial direction D12 opposite to the first axial direction D11. The second groove 454B is arranged apart from the first groove 454A and axially extends along a portion of the width of the bearing element 450 in the direction opposite to the first groove 454A. For example, the second groove 454B is arranged opposite to the first bearing groove 454A on the inner bearing surface 452, and is open in the second axial direction D12 and closed in the first axial direction D11.

In some examples, a width (such as W11 or W12) of the grooves 454 ranges between about 95% and about 5%. In other examples, the width (such as W11 or W12) of the grooves 454 ranges between about 70% and about 30%. In yet other examples, the width (such as W11 or W12) of the grooves 454 ranges between about 60% and about 40%.

Referring again to FIGS. 2 and 3, the bearing element 450 is configured to support the drive shaft 190. As such, the drive shaft 190 can be supported by both the bearing element 194 (also referred to herein as the first bearing element) and the bearing element 450 (also referred to herein as the second bearing element). In the illustrated example, the bearing element 194 is configured as a roller bearing, and the bearing element 450 is configured as a journal bearing.

In some examples, the first bearing element 194 is configured and arranged to take a thrust force axially applied from the rotor 130. As described herein, the rotor 130 is axially pushed toward the drive shaft 190 by, for example, a thrust plate 460, to secure the coupling between the rotor 130 and the drive shaft 190. In some examples, the drive shaft 190 has an extended portion 196 that radially extends over a bearing seat 197 on which the first bearing element 194 is arranged. The extended portion 196 of the drive shaft 190 seats on a portion of the first bearing element 194 when the first bearing element 194 is disposed around the bearing seat 197. With this configuration, the axial thrust force applied to the drive shaft 190 from the rotor side can be at least partially carried by the first bearing element 194 and thus the housing 102.

Referring to FIGS. 2, 3, 4C, 4D, 19, and 20, in some examples, a thrust plate 460 is disposed behind the rotor 130 to axially push the rotor 130 toward the drive shaft 190. The thrust plate 460 thus provides thrust load into the coupling of the rotor 130 and the drive shaft 190 to secure the coupling therebetween. For example, the thrust plate 460 is arranged at the outlet end 135 of the rotor 130 and seats against the mounting flange 118 of the pintle 110. In some examples, the thrust plate 460 includes one or more spring elements 462 configured and arranged to exert axial force on the rotor 130 toward the drive shaft 190 (i.e., away from the mounting flange 118 of the pintle 110). The spring elements 462 can be of various types. In some examples, the spring elements include coil springs. In other examples, the spring elements 462 include wave springs.

In some examples, the mounting flange 118 of the pintle 110 includes spring holes 464 to receive the spring elements 462. In some examples, the spring holes 464 are closed by plugs 466 such that the spring elements 462 seats against the plugs 466. The position of the plugs 466 can be adjusted within the spring holes 464 to adjust the spring pressure of the spring elements 462 against the thrust plate 460.

The thrust plate 460 can include an anti-rotation mechanism that prevents the thrust plate 460 from rotating relative to the pintle 110. In some examples, one or more pins or keys 468 are provided and disposed between the back of the thrust plate 460 and the front of the mounting flange 118 of the pintle 110. For example, one end of the pin is engaged with the back of the thrust plate 460 and the other end of the pin is engaged with the front of the mounting flange 118 of the pintle 110. The pins 468 prevent the thrust plate 460 from spinning as the rotor 130 rotates.

The thrust plate 460 can be made of various materials. One example material for the thrust plate 460 is bronze while the rotor 130 is made of steel. The thrust plate 460 can be of various configurations. In one example, the thrust plate 460 includes a plurality of sector-shaped pads 470 arranged in a circle around the face of the plate. The pads 470 can be free to pivot in some examples. The pads 470 create wedge-shaped regions of fluid or oil inside the plate between the pads and a disk, which support the applied thrust and eliminate metal-on-metal contact. One example of the thrust plate 460 is available from Kingsbury, Inc., Philadelphia, Pa.

Figure 21:
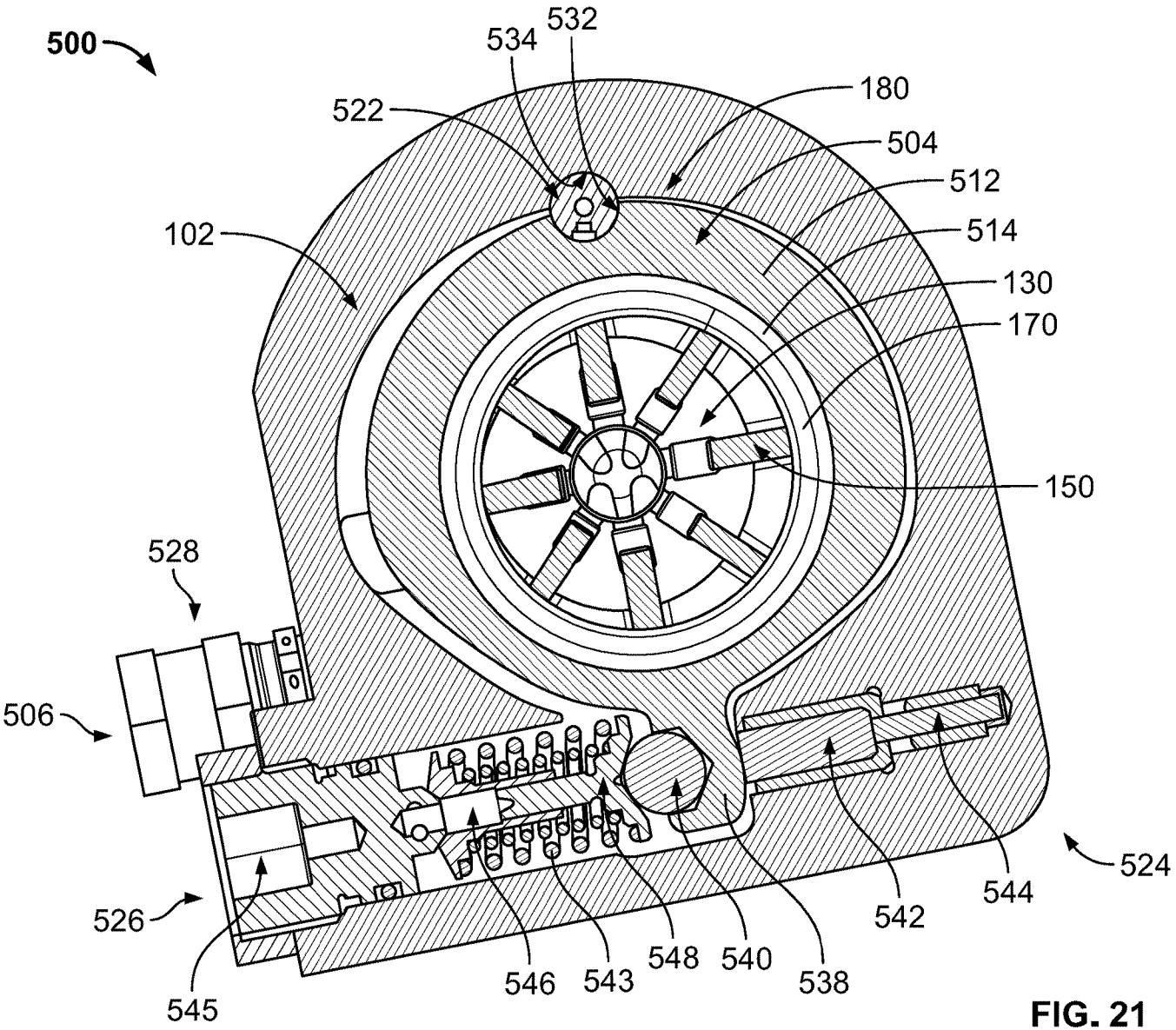
FIG. 21 is a cross sectional view of the radial piston device with an example ring displacement device.
Figure 22:
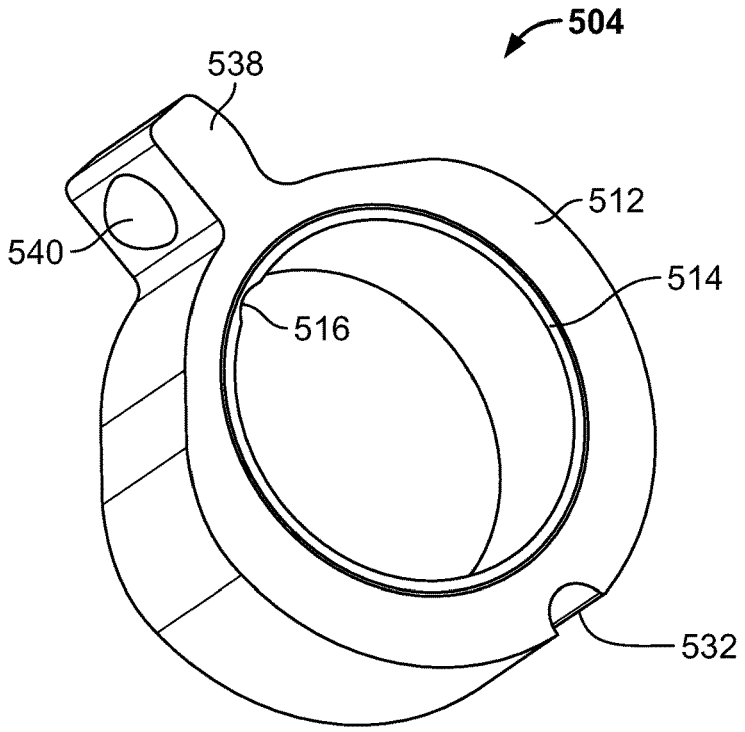
FIG. 22 is a perspective view of an example ring assembly.
Figure 23:
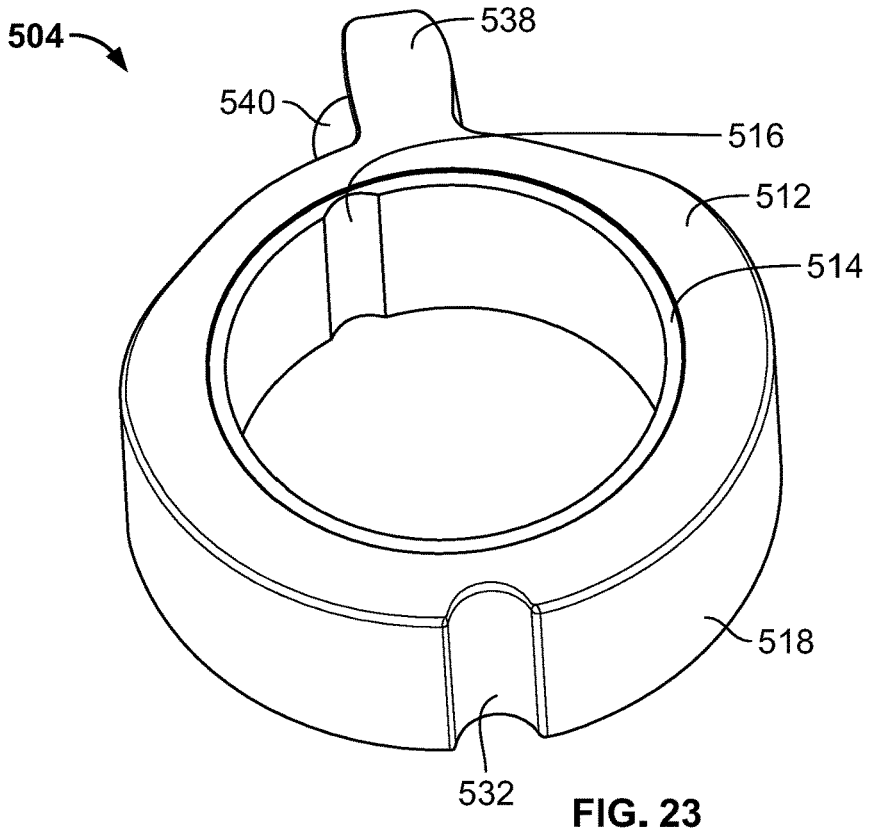
FIG. 23 is another perspective view of the ring assembly of FIG. 22.
Figure 26A:
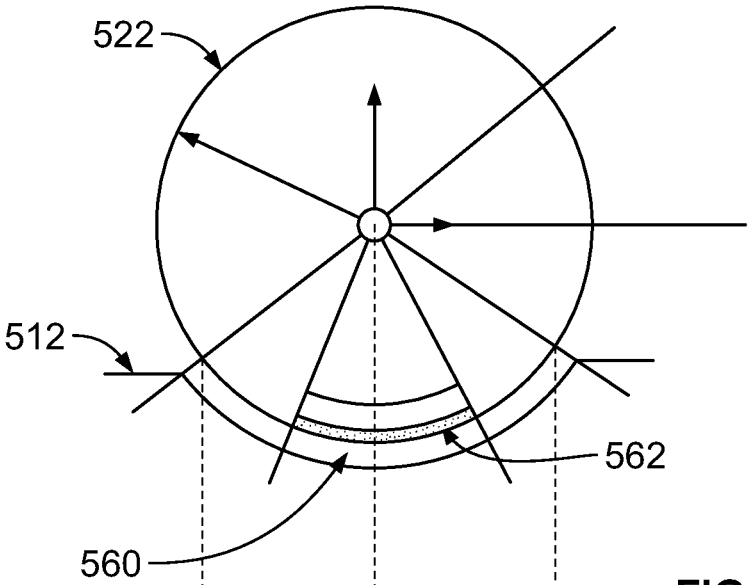
FIG. 26A illustrates a front view of an example pivot pin.
Figure 26B:
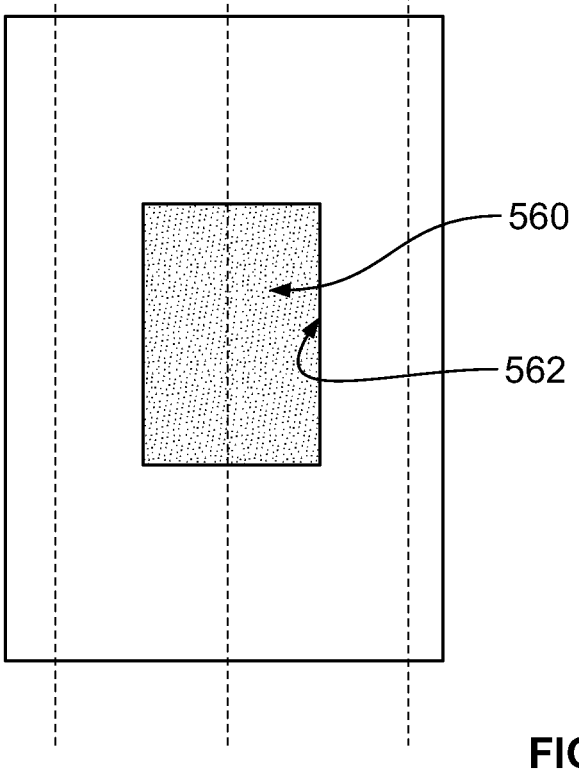
FIG. 26B illustrates a top view of the pivot pin of FIG. 26A.
Figure 27:
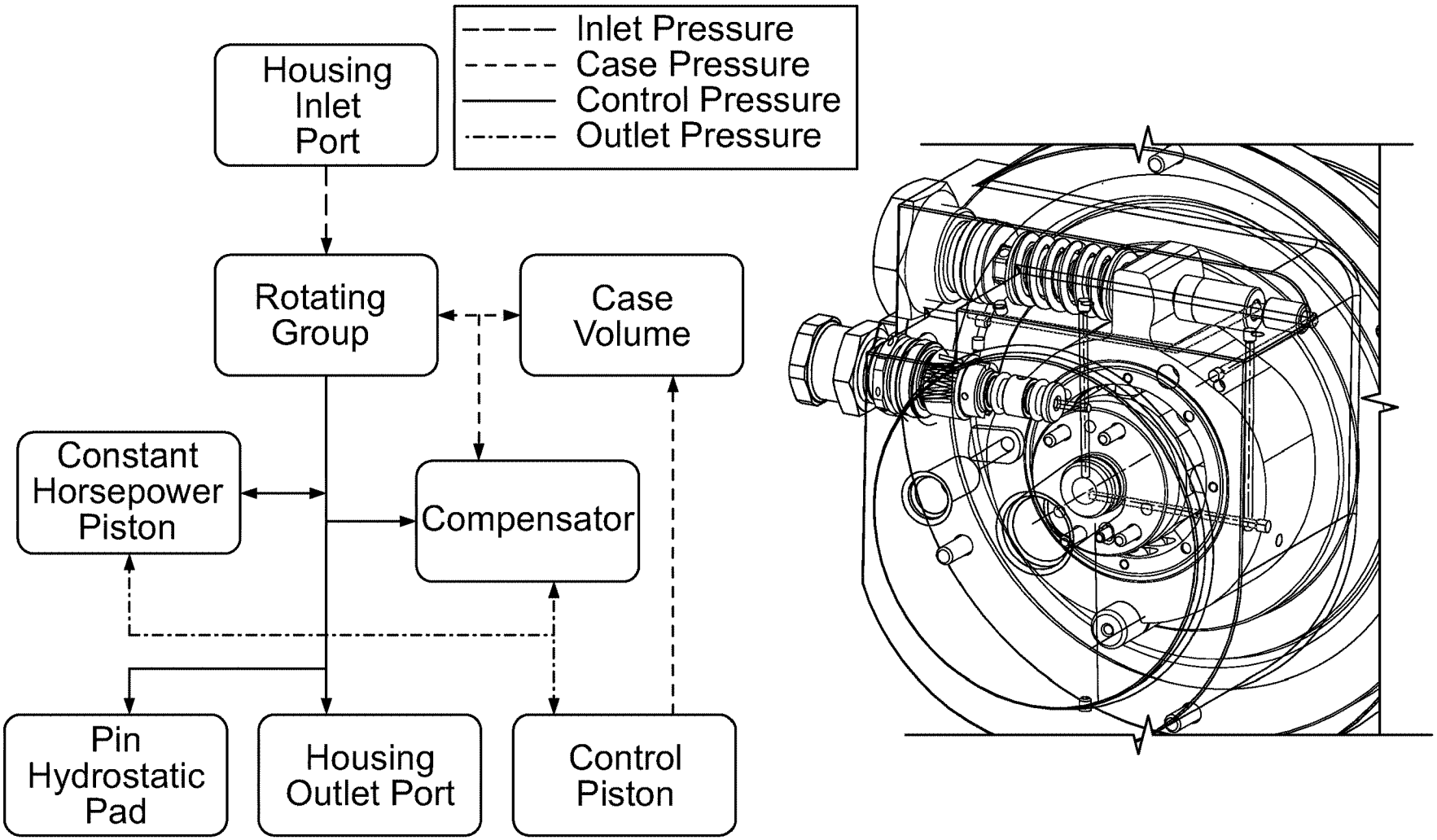
FIG. 27 shows a control circuit flow diagram for a variable displacement control mechanism.

Referring to FIGS. 21-27, an example of the ring displacement device 180. In particular, FIG. 21 is a cross sectional view of the radial piston device 100 illustrating an example ring displacement device 180. FIG. 22 is a perspective view of an example ring assembly, and FIG. 23 is another perspective view of the ring assembly of FIG. 22. FIGS. 24A and 24B illustrate the radial piston device 100 in a minimum displacement operation and in a maximum displacement operation. FIG. 25 illustrates a movement of the ring displacement device 180 between the maximum displacement operation and the minimum displacement operation. FIGS. 26A and 26B illustrate front and top views of an example pivot pin. FIG. 27 shows a control circuit flow diagram for a variable displacement control mechanism, which is implemented in the housing 102.

The ring displacement device 180 provides a variable displacement control mechanism 500 in the radial piston device 100. The variable displacement control mechanism provides a hydraulic power saving mode where fluid pumping load is controlled. As described herein, the variable displacement control mechanism operates to control piston stroke through a pressure compensated control circuit. The variable displacement control mechanism controls the ring displacement device 180 to ensure stable and positive ring displacement moments.

Example configurations and operations of the variable displacement control mechanism 500 are described in U.S. Patent Application Publication No. 2016/0208610, filed Jan. 14, 2016, the disclosure of which is hereby incorporated by reference in its entirety.

Referring to FIG. 21, the variable displacement control mechanism 500 includes a control circuit 502 that controls the ring displacement device 180. In some examples, the ring displacement device 180 includes a ring assembly 504 and a control device 506.

As also illustrated in FIGS. 22 and 23, the ring assembly 504 includes a cam ring 512 and a bearing element 514. The cam ring 512 is disposed radially around the piston ring 170 and defines a space configured to at least partially receive and rotatably support the piston ring 170. The piston ring 170 can rotate about the piston ring axis of rotation $A_T$ relative to the cam ring 512. The cam ring 512 can be made of various materials. One example material is steel. Other materials are also possible for the cam ring 512.

The bearing element 514 can be disposed between the piston ring 170 and the cam ring 512 to ensure the rotation of the piston ring 170 relative to the cam ring 512. In some examples, the bearing element 514 is interference-fitted (e.g., press-fitted) to the inner diameter of the cam ring 512. In this configuration, the piston ring 170 can slide on the inner surface of the bearing element 514 as it rotates about the piston ring axis of rotation $A_T$. The bearing element 514 can be made of various materials. One example material is bronze. Another example material is brass. Other materials are also possible for the bearing element 514.

In some examples, the bearing element 514 has a lubrication groove 516 for lubricating the piston ring 170 therein. The groove 516 can be formed on the inner diameter of the bearing element 514 and axially extend along the width of the bearing element 514. In some examples, the lubrication groove 516 is arranged generally oppositely to a load zone 518 on which fluid load pressure is substantially exerted. The lubrication groove 516 can be positioned adjacent the inlet side 125 of the pintle shaft 112 (i.e., adjacent the rotor inlet communication port 312 of the pintle shaft 112 through which fluid flows from the pintle inlet channel 114 to the rotor 130). As described herein, the inlet side 125 has a pressure load smaller than the outlet side 127 of the pintle shaft 112, the rotor 130 can be lifted up from the pintle shaft 112 toward the load zone 518. Therefore, the load zone 518 on the bearing element 514 takes load pressure larger than the other portion of the bearing element 514.

Although one lubrication groove is primarily described, it is also possible in other examples to include a plurality of lubrication grooves provided to the bearing element 514.

Referring still to FIGS. 21-23, the control device 506 operates to adjust a position of the ring assembly 504 within the housing 102. In the illustrated example, the control device 506 can displace the ring assembly 504 within the housing 102 such that the piston ring axis of rotation $A_T$ is offset from the rotor axis of rotation $A_R$. In some examples, the control device 506 operates the ring assembly 504 to roll or pivot in the housing 102 to shift the piston ring axis of rotation $A_T$ from the rotor axis of rotation $A_R$.

In some examples, the control device 506 includes an anti-slip element 522, a control piston assembly 524, a return device 526, and a compensator 528.

The anti-slip element 522 operates to prevent the ring assembly 504 from slipping on the inner surface of the housing 102 (e.g., the rotor housing 106) as the ring assembly 504 rolls thereon by the operation of the control device 506. In some examples, the anti-slip element 522 is a pin configured to engage a pin groove 532 formed on the outer surface of the cam ring 512 and a groove 534 formed on the inner surface of the housing 102 (e.g., the rotor housing 106). With this configuration, the ring assembly 504 can be pivoted with respect to the pin (i.e., the anti-slip element 522). In this document, therefore, the anti-slip element 522 is also referred to as the pin or pivot pin 522.

In some examples, the ring displacement device 180 includes a hydrostatic pad interface 560 with the pivot pin 522 to bear rotor load which is transferred to the pivot pin 522 through the ring assembly 504. As also illustrated in FIGS. 26A and 26B, the hydrostatic pad interface 560 is defined by a groove 562 formed on the pivot pin 522. The groove 562 is arranged to face the pin groove 532 of the cam ring 512. As shown in FIG. 3, the pivot pin 522 includes a channel 564 that connects the hydraulic fluid outlet 122 to the pin groove 532 to permit fluid to flow into the pin groove 532. Hydraulic fluid that fills in the pin groove 532 operates as a hydrostatic bearing at the pivot pin 522.

As shown back in FIG. 3, the pivot pin 522 can be fixed relative to the housing 102 using an anti-rotation pin or key 566. With this configuration, the ring assembly 504 slides on the pivot pin 522 as the ring assembly 504 pivots with respect to the pivot pin 522.

On the opposite side of the pivot pin 522 are positioned the control piston assembly 524 and the return device 526. In some examples, the ring assembly 504 includes a ring tab 538, which, for example, extends from the cam ring 512. The ring tab 538 is contacted by the control piston assembly 524 and the return device 526 to control the position of the ring assembly 504. In some examples, the control piston assembly 524 is arranged on one side of the ring tab 538, and the return device 526 is arranged on the other side of the ring tab 538, such that the control piston assembly 524 and the return device 526 apply force to the ring tab 538 in opposite directions.

In some examples, the ring tab 538 is provided with a ball 540 fixed thereto and configured to provide an interface with the return device 526. In other examples, the ball 540 is arranged on the other side of the ring tab 538 to contact the control piston assembly 524. In yet other examples, both sides of the ring tab 538 mount balls for interacting with the return device 526 and the control piston assembly 524 from the both sides.

Referring still to FIG. 21, the control piston assembly 524 includes a control piston 542 and a constant power piston 544 (also referred to herein as a constant horse power piston or CHP). The control piston 542 is abutted with the ring tab 538 at one end and engaged with the constant power piston 544 at the other end, and is actuated by the constant power piston 544. The control piston assembly 524 can be hydraulically powered. In some examples, the constant power piston 544 applies continuous force to the control piston 542 by utilizing outlet hydraulic pressure. The control piston 542 then applies force to the ring tab 538 to pivot the ring assembly 504 with respect to the pivot pin 522.

The return device 526 operates to return the ring assembly 504 to its initial position. For example, the return device 526 includes a spring element 543 (e.g., a set of two parallel helical compression springs) that seats on a spring seat 545 and are guided by a first spring guide 546 and a second spring guide 548. The second spring guide 548 can be telescopically received in the first spring guide 546, and extends out from, or retracts into, the first spring guide 546. The spring element 543 is configured to apply force to the ring tab 538 against the control piston assembly 524.

In some examples, the compensator 528 includes a spring loaded spool valve configured to sense the pump outlet pressure and balance the spool by the case drain pressure and the spring force against the pump outlet pressure. For example, in the maximum displacement operation, the return device 526 retains the ring assembly 504 to be pivoted in the maximum displacement operation (i.e., a maximum eccentricity) until a predetermined flow pressure is reached. By way of example, the predetermined flow pressure ranges between about 2000 psi and about 2500 psi. In one possible example, the predetermined flow pressure is about 2175 psi. Once the outlet pressure goes beyond the predetermined flow pressure, it overcomes the spring loaded spool force and generates control pressure to act on the control piston differential area. This de-strokes the control piston assembly 524 to reduce displacement or flow to the pump outlet until the pressure drops below a compensator set point. An example control circuit flow is illustrated in FIG. 27.

Figure 24B:
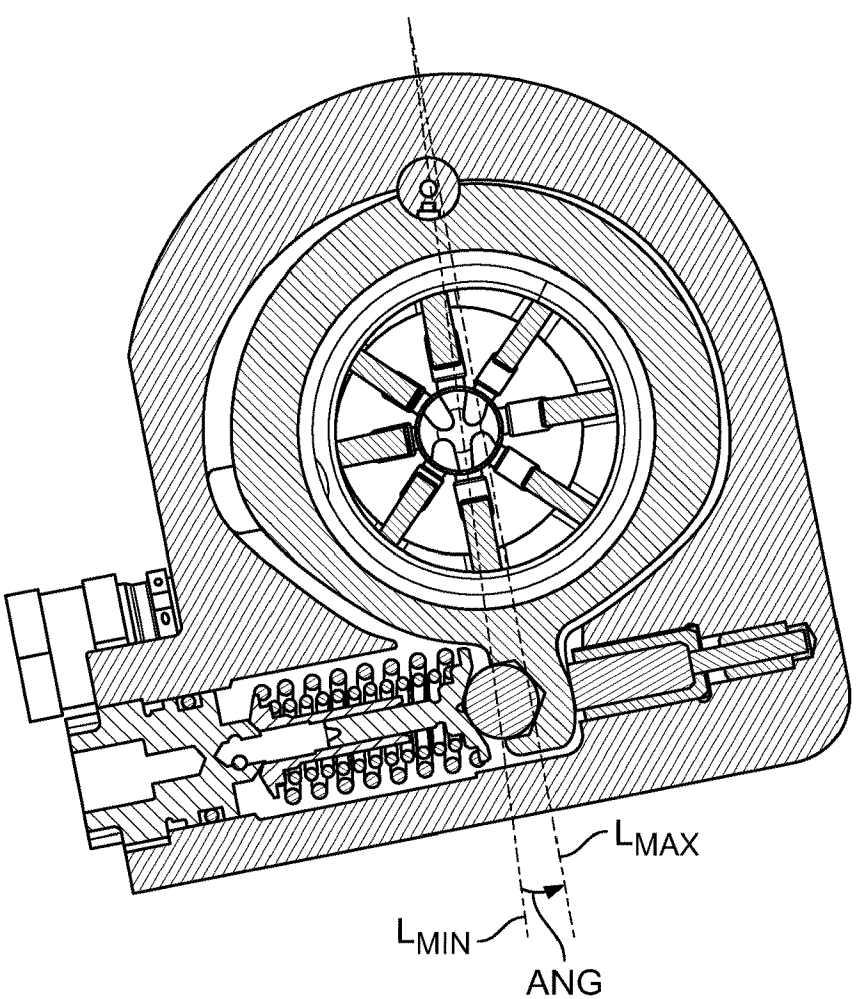
FIG. 24B illustrates the radial piston device in a maximum displacement operation.
Figure 24A:
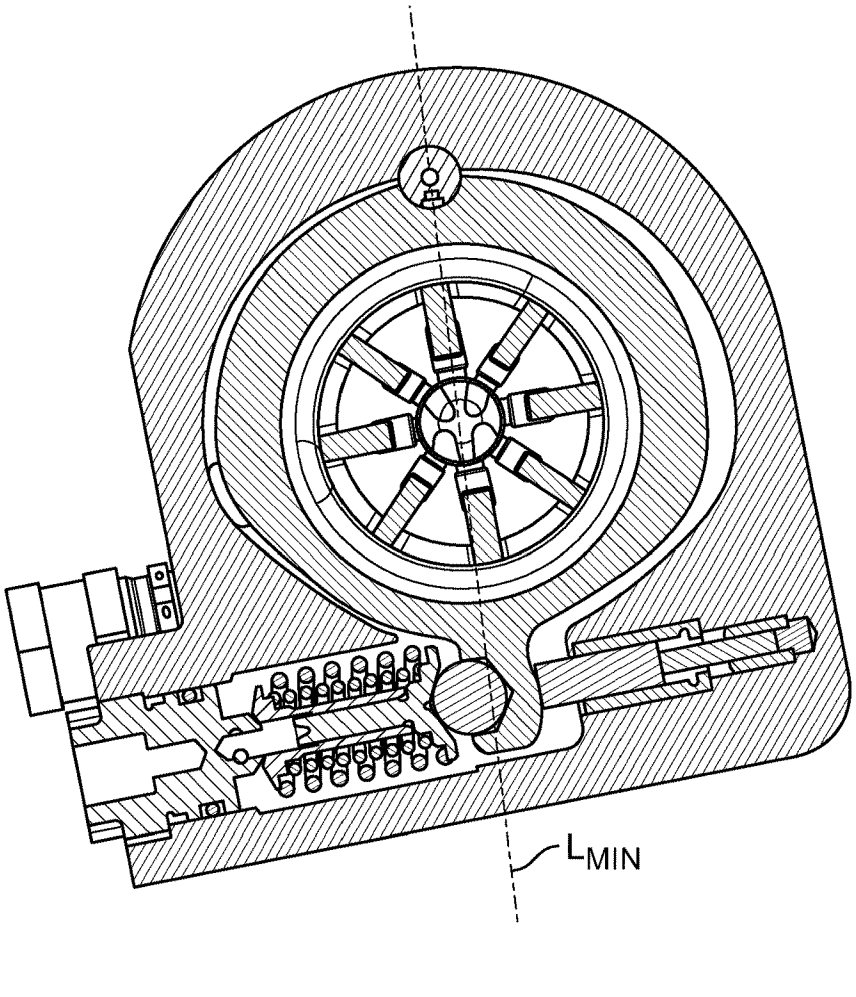
FIG. 24A illustrates the radial piston device in a minimum displacement operation.

The ring displacement device 180 operates to move the ring assembly 504 including the piston ring 170 between the minimum displacement position (FIG. 24A) and the maximum displacement position (FIG. 24B). As the piston ring 170 moves between the minimum displacement position and the maximum displacement position, the piston ring axis $A_T$ moves in an arc with respect to the pivot pin 522.

The variable displacement control mechanism 500 of the present disclosure can reduce the movement of the ring assembly 504. As depicted in FIG. 25, a line $L_{MIN}$ is defined as a line extending through the centers of the piston ring 170 and the pivot pin 522 in the minimum displacement operation, and a line $L_{MAX}$ is defined as a line extending through the centers of the piston ring 170 and the pivot pin 522 in the maximum displacement operation. In some examples, either or both of the lines $L_{MIN}$ and $L_{MAX}$ are not in parallel with an axis (e.g., Y-axis in FIGS. 24A, 24B, and 25) perpendicular to an axis (e.g., X-axis in FIGS. 24A, 24B, and 25) along which the control piston assembly 524 and the return piston 526 are arranged and operated. For example, in FIGS. 24A, 24B, and 25, the line $L_{MIN}$ is arranged to be not in line with Y-axis, but away from the Y-axis in one direction (e.g., on the left of the Y-axis), and the line $L_{MAX}$ is arranged to be not in line with the Y-axis but away from the Y-axis in the other direction (e.g., on the right of the Y-axis). This configuration improves the responsiveness of fluid displacement rate change as the ring assembly 504 is controlled.

An angle ANG between the lines $L_{MIN}$ and $L_{MAX}$ indicates a range over which the ring assembly 504 (or the piston ring 170) pivots with respect to the pivot pin 522. In some examples, the angle ANG ranges from about 1 to about 10 degrees. In other examples, the angle ANG ranges from about 2 to about 5 degrees. In yet other examples, the angle ANG is about 3.5 degrees.

Further, the control mechanism 500 operates to move the piston ring 170 (or the ring assembly 504) such that the piston ring axis $A_T$ of the piston ring 170 (or the ring assembly 504) follows a curved path (as shown in FIG. 25) around the rotor axis $A_R$ of rotation of the rotor 130.

Referring back to FIGS. 4A and 4B, in some examples, a ring coupling element 172 is provided to prevent the pistons 150 from turning the piston ring 170 as the rotor 130 rotates about the pintle shaft 112. The pistons 150 are designed to roll against an inner diameter of the piston ring 170. However, in some applications, the pistons 150 can slide against the inner diameter of the piston ring 170, thereby exerting a thrust stress on the inner face of the piston ring 170. The ring coupling element 172 is configured to avoid the pistons 150 from causing the piston ring 170 to turn excessively or unacceptably.

For example, the ring coupling element 172 is disposed between the piston ring 170 and the drive shaft 190 so as to connect the piston ring 170 to the drive shaft 190. The ring coupling element 172 can be configured to permit the eccentric rotation of the piston ring 170 relative to the drive shaft 190 and the rotor 130. As the drive shaft 190 is connected to the rotor 130 via, for example, the coupling device 200, the ring coupling element 172 is also connected to the rotor 130. As the device 100 works as a pump, the drive shaft 190 drives the rotor 130 via the coupling device 200, and drives the piston ring 170 via the ring coupling element 172. When driven by the drive shaft 190, the piston ring 170 rotates about the piston ring axis of rotation $A_T$ while the rotor 130 rotates about the rotor axis of rotation $A_R$, which is offset from the piston ring axis of rotation $A_T$.

The ring coupling element 172 is configured to transfer the rotation of the drive shaft 190 to the rotation of the piston ring 170 while permitting the piston ring 170 slides radially relative to the drive shaft 190. In some examples, the piston ring 170 includes a plurality of ring teeth 174 to engage the ring coupling element 172. For example, the ring coupling element 172 has a plurality of first receivers 176 for receiving the plurality of ring teeth 174 of the piston ring 170 on one side, and a plurality of second receivers 178 for receiving the shaft teeth 198 of the drive shaft 190 on the other side. In some embodiments, the second receivers 178 of the ring coupling element 172 are configured as grooves radially extending along an entire axial end face of the ring coupling element 172 such that, when the shaft teeth 198 of the drive shaft 190 are engaged with the receivers 178 of the ring coupling element 172, the ring coupling element 172 are slidable radially following the shaft teeth 198 of the drive shaft 190. Therefore, the shaft teeth 198 of the drive shaft 190 can circumferentially engage the receivers 178 of the ring coupling element 172 to transfer the torque from the drive shaft 190 while permitting the receivers 178 of the ring coupling element 172 to radially slide along the shaft teeth 198 of the drive shaft 190, thereby causing the piston ring 170 to rotate in an axis (i.e., the piston ring axis $A_T$) different from the drive shaft axis or the rotor axis. One example of the ring coupling element 172 is an Oldham coupling. Other types of coupling are also possible in other examples.

The ring coupling element 172 can be of various configurations. In some examples, the ring coupling element 172 is configured to be flexible so as to allow for misalignment between the piston pin axis $A_T$ and a shaft axis $A_S$. In other examples, the drive shaft 190 and the piston ring 170 may be directly engaged with each other, without the use of the ring coupling element 172.

As described herein, a hydraulic radial piston device includes a housing, a pintle, a rotor, a plurality of pistons, and a drive shaft. In other examples, the radial piston device may further include a ring displacement device. The pintle is attached to the housing and having a pintle shaft. The rotor is mounted on the pintle shaft and configured to rotate relative to the pintle shaft about a rotor axis of rotation. The rotor defines a plurality of cylinders. The plurality of pistons each are displaceable in each of the plurality of cylinders. The piston ring is disposed around the rotor and has a piston ring axis of rotation. The piston ring is configured to rotate about the piston ring axis of rotation as the rotor rotates relative to the pintle shaft about the rotor axis of rotation. The drive shaft is rotatably supported within the housing and rotatable with the rotor. In some examples, the ring displacement device is configured to move the piston ring through a range of movement within the housing between a first position in which the radial piston device has a minimum displacement of hydraulic fluid per each rotation of the rotor and a second position in which the radial piston device has a maximum displacement of hydraulic fluid per each rotation of the rotor.

In certain examples, the housing has a hydraulic fluid inlet and a hydraulic fluid outlet.

In certain examples, a pintle has a first pintle end and a second pintle end opposite to the first pintle end along a pintle axis, the pintle attached to the housing at the second pintle end and having a pintle shaft extending between the first pintle end and the second pintle end. The pintle shaft defines a pintle inlet channel and a pintle outlet channel. The pintle inlet channel extends between a pintle inlet port and a rotor inlet communication port, the pintle inlet port in fluid communication with the hydraulic fluid inlet at the first pintle end, and the rotor inlet communication port defined on the pintle shaft between the first pintle end and the second pintle end. The pintle outlet channel extends between a rotor outlet communication port and a pintle outlet port, the rotor outlet communication port defined on the pintle shaft between the first pintle end and the second pintle end, and the pintle outlet port in fluid communication with the hydraulic fluid outlet at the second pintle end, wherein the rotor inlet communication port and the rotor outlet communication port are arranged oppositely around the pintle shaft.

In certain examples, the pintle includes a pintle wall extending at least partially along the pintle inlet channel and separating the pintle inlet channel into two sections. In certain examples, the pintle includes an integral bearing surface defined around the pintle shaft and providing a surface against which a rotor rotates, the bearing surface surrounding the rotor inlet communication port and the rotor outlet communication port on the pintle shaft.

In certain examples, the bearing surface includes an inlet surface that is depressed from the bearing surface, the rotor inlet communication port being defined on the inlet surface to facilitate fluid flow from the rotor inlet communication port to the rotor therethrough. In certain examples, the bearing surface includes an outlet surface that is depressed from the bearing surface, the rotor outlet communication port being defined on the outlet surface to facilitate fluid flow from the rotor to the rotor outlet communication port therethrough, In certain examples, the pintle includes an inlet timing recess formed on the pintle shaft and in fluid communication with the rotor inlet communication port. The inlet timing recess is configured to provide fluid communication between the rotor inlet communication port and the rotor as the rotor rotates about the pintle shaft. In certain examples, the pintle includes an outlet timing recess similar to the inlet timing recess.

In certain examples, the bearing surface includes an inlet fluid passage surface (i.e., a pintle lube groove) that cooperates with the rotor to define a fluid passage between the first pintle end and the rotor inlet communication port over an exterior of the pintle shaft. In certain examples, the bearing surface includes a case leakage prevention surface (i.e., another pintle lube groove) similar to the inlet fluid passage surface.

In certain examples, the rotor is mounted on the pintle shaft and configured to rotate relative to the pintle shaft about a rotor axis of rotation, the rotor axis of rotation extending through a length of the pintle shaft. The rotor may include a plurality of cylinders arranged in a plurality of rows of cylinders, the rows being extending about the rotor axis of rotation, and each row of cylinders including a pair of radially oriented cylinders. The rotor may further include a plurality of rotor fluid ports, each rotor fluid port being in fluid communication with at least one of the pair of radially oriented cylinders and being alternatively in fluid communication with either the rotor inlet communication port of the pintle shaft or the rotor outlet communication port of the pintle shaft.

In certain examples, each rotor fluid port includes a first port being in fluid communication with one of the pair of radially oriented cylinders through a first rotor port channel, and a second port overlapping the first port and being in fluid communication with the other one of the pair of radially oriented cylinders through a second rotor port channel, the first rotor port channel crossing the second rotor port channel.

In certain examples, the thrust ring is disposed about the rotor and has a thrust ring axis of rotation. The thrust ring is in contact with the plurality of pistons. The thrust ring may have an outer surface, an inner surface, a first lateral face extending between the outer surface and the inner surface, and a second lateral face opposite to the first lateral face and extending between the outer surface and the inner surface. The inner surface provides a contact surface with which the plurality of pistons are selectively in contact. The inner surface has a first diameter at a first plane perpendicular to the thrust ring axis of rotation and defined between the first and second lateral faces, a second diameter at a second plane incorporating the first lateral face, and a third diameter at a third plane incorporating the second lateral face. The first diameter may be larger than the second diameter and the third diameter.

In certain examples, the thrust ring has a Kingsbury pad configuration. For example, the first lateral face includes a plurality of radially extending grooves, and the second lateral face includes a plurality of radially extending grooves.

In certain examples, the drive shaft is rotatably supported within the housing and has a driving end and a power transfer end, the drive shaft including a shaft body at the driving end and a power transfer flange at the power transfer end. The power transfer flange is configured to be connected to the rotor and defines a flow passage being in fluid communication with the pintle inlet port of the pintle shaft. The drive shaft may include a crossbar provided to the power transfer flange, the crossbar extending across the flow passage and being offset from the rotor (or a face of the rotor). The drive shaft may include at least one engagement element (e.g., teeth) formed on the power transfer flange and configured to engage the rotor via a coupling device, such as Oldham's ring.

In certain examples, the coupling device is disposed between the drive shaft and the rotor and configured to couple the draft shaft and the rotor to transfer torque therebetween. The coupling device may include at least one rotor engagement recess and at least one drive shaft engagement recess. The rotor engagement recess is configured to engage the engagement element of the rotor and has a radially-extending lateral surface configured to abut with a radially-extending lateral surface of the engagement element of the rotor. At least one of the radially-extending lateral surface of the rotor engagement recess and the radially-extending lateral surface of the engagement element of the rotor has a raised portion. The drive shaft engagement recess is configured to engage the engagement element of the drive shaft, and has a radially-extending lateral surface configured to abut with a radially-extending lateral surface of the engagement element of the drive shaft. At least one of the radially-extending lateral surface of the drive shaft engagement recess and the radially-extending lateral surface of the engagement element of the drive shaft has a raised portion.

In certain examples, the bearing element is disposed between an inner surface of the housing and the power transfer flange of the drive shaft. The bearing element provides an inner bearing surface against which the power transfer flange slides as the drive shaft rotates relative to a drive shaft axis of rotation. The inner bearing includes a first groove and a second groove. The first groove being axially extending and open in a first axial direction (i.e., toward the rotor) and closed in a second axial direction opposite to the first axial direction. The second groove being axially extending and open in the second axial direction and closed in the first axial direction. In some examples, the first and second grooves may extend about 60-70% of the axial width of the bearing element.

The various examples and teachings described above are provided by way of illustration only and should not be construed to limit the scope of the present disclosure. Those skilled in the art will readily recognize various modifications and changes that may be made without following the examples and applications illustrated and described herein, and without departing from the true spirit and scope of the present disclosure.

What is claimed is:

1. A hydraulic radial piston device comprising:

a housing;

a pintle attached to the housing and having a pintle shaft, the pintle having a fluid inlet end and an opposite fluid outlet end;

a rotor mounted on the pintle shaft and configured to rotate relative to the pintle shaft about a rotor axis of rotation, the rotor having a plurality of cylinders;

a plurality of pistons, each being displaceable in each of the plurality of cylinders;

a piston ring disposed around the rotor and having a piston ring axis of rotation, the piston ring configured to rotate about the piston ring axis of rotation as the rotor rotates relative to the pintle shaft about the rotor axis of rotation; and a drive shaft rotatably supported within the housing and rotatable with the rotor;

wherein the pintle includes an integrated bearing surface for supporting rotation of the rotor either directly or by an intermediate fluid, wherein the pintle includes a lubrication groove defined though the integrated bearing surface and configured to feed hydraulic fluid for lubricating the integrated bearing surface, wherein the lubrication groove includes a first pintle lubrication groove that extends through the integrated bearing surface at an exterior of the pintle between the fluid inlet end of the pintle and one of a rotor inlet communication port and a rotor outlet communication port, wherein the lubrication groove includes a second pintle lubrication groove that extends through the integrated bearing surface at the exterior of the pintle between the fluid outlet end of the pintle and one of the rotor inlet communication port and the rotor outlet communication port, the integrated bearing surface integrally formed to surround the rotor inlet communication port and the rotor outlet communication port except for at the first and second lubrication grooves, the rotor inlet communication port formed on the pintle shaft and configured to be selectively in fluid communication with the plurality of cylinders, and the rotor outlet communication port formed on the pintle shaft and configured to be selectively in fluid communication with the plurality of cylinders;

wherein the first and second pintle lubrication grooves extend axially along a length of the pintle.

2. The radial piston device of claim 1, wherein the pintle includes a pintle wall extending at least partially along a pintle inlet channel defined by the pintle shaft.

3. The radial piston device of claim 2, wherein the pintle wall is configured to separate the pintle inlet channel into two sections.

4. The radial piston device of claim 1, wherein the pintle includes an inlet recess being depressed from the integrated bearing surface and the rotor inlet communication port is defined on the inlet recess.

5. The radial piston device of claim 4, wherein the pintle includes an outlet recess being depressed from the integrated bearing surface and the rotor outlet communication port is defined on the outlet recess.

6. The radial piston device of claim 5, wherein the pintle includes a timing recess configured to adjust timing of fluid communication between the rotor outlet communication port and the plurality of cylinders.

7. The radial piston device of claim 6, wherein the timing recess includes a first outlet timing recess and a second outlet timing recess, the first and second outlet timing recesses formed on the pintle shaft and abutted to opposite sides of the outlet recess, respectively, so as to be in fluid communication with the rotor outlet communication port through the outlet recess.

8. The radial piston device of claim 5, wherein the first and second pintle lubrication grooves each extend to the inlet recess.

9. The radial piston device of claim 4, wherein the pintle includes a timing recess configured to adjust timing of fluid communication between the rotor inlet communication port and the plurality of cylinders.

10. The radial piston device of claim 9, wherein the timing recess includes a first inlet timing recess and a second inlet timing recess, the first and second inlet timing recesses formed on the pintle shaft and abutted to opposite sides of the inlet recess, respectively, so as to be in fluid communication with the rotor inlet communication port through the inlet recess.

11. The radial piston device of claim 1, wherein the plurality of cylinders of the rotor are arranged in a plurality of rows of cylinders, the rows extending about the rotor axis of rotation, and each row of cylinders including a pair of radially oriented cylinders, the rotor further including:

a plurality of rotor fluid ports, each rotor fluid port being in fluid communication with the pair of radially oriented cylinders and being alternatively in fluid communication with either the rotor inlet communication port of the pintle shaft or the rotor outlet communication port of the pintle shaft;

wherein each rotor fluid port includes a first rotor port channel connected to one cylinder of the pair of radially oriented cylinders and a second rotor port channel connected to the other cylinder of the pair of radially oriented cylinders, the first rotor port channel and the second rotor port channel being formed by cross-drilling.

12. The radial piston device of claim 1, wherein the plurality of cylinders of the rotor are arranged in a plurality of rows of cylinders, the rows extending about the rotor axis of rotation, the rotor further including:

at least one flat face arranged adjacent at least one of the plurality of rows of cylinders and extending axially on an outer surface of the rotor to include openings of the at least one of the plurality of rows of cylinders.

13. The radial piston device of claim 1, wherein the piston ring has a V-shape configuration on an inner diameter thereof.

14. The radial piston device of claim 13, wherein the piston ring has an inner diameter and an outer diameter, the inner diameter and the outer diameter axially extending between opposite axial end faces, the inner diameter having a first radius measured around the piston ring axis at a fillet point of the piston ring and a second radius measured around the piston ring axis at the axial end faces, the first radius being greater than the second radius.

15. The radial piston device of claim 1, wherein the piston ring has an inner diameter and an outer diameter, the inner diameter and the outer diameter axially extending between opposite axial end faces, the piston ring including:

one or more radially extending grooves formed on at least one of the axial end faces between the inner diameter and the outer diameter and configured to enable hydraulic fluid to travel between the inner diameter and the outer diameter.

16. The radial piston device of claim 1, wherein the drive shaft has a driving end and a power transfer end, the drive shaft including a shaft body at the driving end and a power transfer flange at the power transfer end, the power transfer flange configured to be connected to the rotor and defining a flow passage being in fluid communication with a pintle inlet channel of the pintle shaft, wherein the drive shaft includes a crossbar provided to the power transfer flange, the crossbar extending across the flow passage and being offset from a base of the power transfer flange.

17. The radial piston device of claim 1, wherein the drive shaft includes at least one engagement element provided on a power transfer flange, and the rotor includes at least one engagement element provided on an inlet end of the rotor.

18. The radial piston device of claim 17, further comprising a coupling element disposed between the drive shaft and the rotor and configured to couple the drive shaft and the rotor to transfer torque therebetween, the coupling element including at least one coupling recess for receiving the at least one engagement element of the power transfer flange and the at least one engagement element of the rotor, the at least one coupling recess having a radially-extending lateral surface configured to contact the at least one engagement element of the power transfer flange or the at least one engagement element of the rotor, the radially-extending lateral surface including a crowned surface.

19. The radial piston device of claim 18, wherein the at least one coupling recess includes one or more rotor engagement recesses and one or more drive shaft engagement recesses, the rotor engagement recesses configured to engage the at least one engagement element of the rotor and having a radially-extending lateral surface configured to abut with the at least one engagement element of the rotor, wherein the radially-extending lateral surface has a crowned portion, and the drive shaft engagement recesses configured to engage the at least one engagement element of the drive shaft and having a radially-extending lateral surface configured to abut with the at least one engagement element of the drive shaft, wherein the radially-extending lateral surface has a crowned portion.

20. The radial piston device of claim 1, further comprising a bearing element disposed between an inner surface of the housing and a power transfer flange of the drive shaft, the bearing element providing an inner bearing surface against which the power transfer flange slides as the drive shaft rotates relative to a drive shaft axis of rotation, wherein the bearing element includes at least one groove formed on the inner bearing surface and extending a portion of an axial width of the bearing element.

21. The radial piston device of claim 20, wherein the at least one groove includes a first groove and a second groove, the first groove being axially extending and open in a first axial direction and closed in a second axial direction opposite to the first axial direction, and the second groove being axially extending and open in the second axial direction and closed in the first axial direction.

22. The radial piston device of claim 21, wherein the first and second grooves extend about 30% to about 70% of the axial width of the bearing element.

23. The radial piston device of claim 1, further comprising a thrust plate disposed behind the rotor and configured to axially push the rotor toward the drive shaft.

24. The radial piston device of claim 23, wherein the thrust plate includes one or more spring elements configured to exert axial force on the rotor toward the drive shaft.

25. The radial piston device of claim 1, further comprising a first bearing element and a second bearing element both disposed within the housing and configured to rotatably support the drive shaft, wherein the drive shaft includes an extended portion radially extending over a bearing seat of the drive shaft on which the first bearing element is arranged, the extended portion of the drive shaft axially seating on the first bearing element to receive axial thrust force applied to the drive shaft from the rotor.

26. The radial piston device of claim 25, wherein the first bearing element is a roller bearing and the second bearing element is a journal bearing.

27. The radial piston device of claim 1, further comprising: a ring displacement device configured to move the piston ring through a range of movement within the housing between a first position in which the radial piston device has a minimum displacement of hydraulic fluid per each rotation of the rotor and a second position in which the radial piston device has a maximum displacement of hydraulic fluid per each rotation of the rotor, wherein the ring displacement device includes a ring assembly, the ring assembly including a cam ring and a bearing element fitted to the cam ring, and the bearing element providing a bearing surface for the piston ring.

28. The radial piston device of claim 27, wherein the bearing element is made of bronze.

29. The radial piston device of claim 27, wherein the ring displacement device further includes a control device, the control device including an anti-slip element configured to prevent the ring assembly from slipping on an inner surface of the housing.

30. The radial piston device of claim 29, wherein the anti-slip element includes a pivot pin, the pivot pin having a groove to receive hydraulic fluid to provide a hydrostatic bearing pad interface.

31. The radial piston device of claim 1, further comprising a ring coupling element configured to couple the drive shaft with the piston ring, the coupling element configured to transfer a torque from the drive shaft to the piston ring and permit the piston ring to radially slide relative to the drive shaft.

32. The radial piston device of claim 1, wherein the rotor includes an even number of cylinders configured to receive an even number of pistons, respectively.

33. The radial piston device of claim 1, wherein the rotor inlet communication port includes first and second rotor inlet communication ports terminating at an inlet recess depressed from the integrated bearing surface and surrounded by the integrated bearing surface, and wherein the rotor outlet communication port includes first and second rotor outlet communication ports terminating at an outlet recess depressed from the integrated bearing surface and surrounded by the integrated bearing surface.

34. The hydraulic piston device of claim 1, wherein the hydraulic radial piston device is a pump, wherein the first pintle lubrication groove extends between the fluid inlet end of the pintle and the rotor inlet communication port, and wherein the second pintle lubrication groove extends between the fluid outlet end of the pintle and the rotor inlet communication port.

35. A hydraulic radial piston device comprising:

a housing;

a pintle attached to the housing and having a pintle shaft, the pintle having a first end and a second end separated by a length of the pintle, the pintle defining a first fluid channel adjacent the first end and a second channel adjacent the second end;

a rotor mounted on the pintle shaft and configured to rotate relative to the pintle shaft about a rotor axis of rotation, the rotor having a plurality of cylinders;

a plurality of pistons, each being displaceable in each of the plurality of cylinders;

a piston ring disposed around the rotor and having a piston ring axis of rotation, the piston ring configured to rotate about the piston ring axis of rotation as the rotor rotates relative to the pintle shaft about the rotor axis of rotation; and a drive shaft rotatably supported within the housing and rotatable with the rotor;

wherein an exterior of pintle shaft includes a bearing surface for supporting rotation of the rotor either directly or by an intermediate fluid, wherein the pintle defines a first rotor communication port in fluid communication with the first fluid channel and a second rotor communication port in fluid communication with the second channel, the exterior of the pintle shaft defining a first recess in fluid communication with the first rotor communication port and a second recess in fluid communication with the second rotor communication port, the bearing surface at least partially surrounding the first and second recesses, the pintle shaft including first and second timing recesses formed as notches in the exterior of the pintle shaft at opposite sides of the first recess, the first rotor communication port configured to be selectively in fluid communication with the plurality of cylinders as the rotor rotates, the second rotor communication port configured to be selectively in fluid communication with the plurality of cylinders as the rotor rotates, and the first and second timing recesses being configured to adjust timing of fluid communication between the first rotor communication port and the plurality of cylinders as the rotor rotates about the pintle shaft.

36. The hydraulic radial piston device of claim 35, wherein the first and second timing recesses are triangular.

37. The hydraulic radial piston device of claim 35, wherein the bearing surface fully surrounds the first recess.

38. The hydraulic radial piston device of claim 35, wherein the bearing surface surrounds the second recess except for a lubrication groove or grooves defined by the exterior of the pintle shaft through the bearing surface, the lubrication groove or grooves providing lubrication of the bearing surface and extending axially along the pintle shaft to the second recess.

39. The hydraulic radial piston device of claim 35, wherein the first recess is an inlet recess and the first and second timing recesses are first and second inlet timing recesses, wherein the pintle shaft includes first and second outlet timing recesses formed as notches in the exterior of the pintle shaft at opposite sides of the second recess, the first and second outlet timing recesses being configured to adjust timing of fluid communication between the second rotor communication port and the plurality of cylinders as the rotor rotates about the pintle shaft.

40. A hydraulic radial piston device comprising:

a housing;

a pintle attached to the housing and having a pintle shaft, the pintle having a first end and a second end separated by a length of the pintle, the pintle defining a first fluid channel adjacent the first end and a second channel adjacent the second end;

a rotor mounted on the pintle shaft and configured to rotate relative to the pintle shaft about a rotor axis of rotation, the rotor having a plurality of cylinders;

a plurality of pistons, each being displaceable in each of the plurality of cylinders;

a piston ring disposed around the rotor and having a piston ring axis of rotation, the piston ring configured to rotate about the piston ring axis of rotation as the rotor rotates relative to the pintle shaft about the rotor axis of rotation;

the pintle shaft having an axial dimension that extends along the rotor axis of rotation and a circumferential direction that extends around the rotor axis of rotation; and a drive shaft rotatably supported within the housing and rotatable with the rotor;

wherein an exterior of the pintle shaft includes a bearing surface for supporting rotation of the rotor either directly or by an intermediate fluid, wherein the pintle defines a first rotor communication port in fluid communication with the first fluid channel and a second rotor communication port in fluid communication with the second channel, the exterior of the pintle shaft defining a first recess in fluid communication with the first rotor communication port and a second recess in fluid communication with the second rotor communication port, the bearing surface surrounding the first recess such that first and second opposite axial sides and first and second opposite circumferential sides of the first recess are bound by the bearing surface, the first rotor communication port configured to be selectively in fluid communication with the plurality of cylinders as the rotor rotates, and the second rotor communication port configured to be selectively in fluid communication with the plurality of cylinders as the rotor rotates;

wherein the pintle shaft includes first and second timing recesses formed as notches in the exterior of the pintle shaft at the opposite first and second circumferential sides of the first recess, the first and second timing recesses being configured to adjust timing of fluid communication between the first rotor communication port and the plurality of cylinders as the rotor rotates about the pintle shaft.

41. The hydraulic radial piston device of claim 40, wherein the first recess is an inlet recess and the first and second timing recesses are first and second inlet timing recesses, wherein the second recess includes opposite first and second circumferential sides and first and second opposite axial sides, wherein the pintle shaft includes first and second outlet timing recesses formed as notches in the exterior of the pintle shaft at the opposite first and second circumferential sides of the second recess, the first and second outlet timing recesses being configured to adjust timing of fluid communication between the second rotor communication port and the plurality of cylinders as the rotor rotates about the pintle shaft.

42. The hydraulic radial piston device of claim 40, wherein the bearing surface axially and circumferentially bounds the second recess except for a lubrication groove or grooves defined by the exterior of the pintle shaft through the bearing surface, the lubrication groove or grooves providing lubrication of the bearing surface and extending axially along the pintle shaft to an axial side of the second recess.

43. A hydraulic radial piston device comprising:

a housing;

a pintle attached to the housing and having a pintle shaft, the pintle having a fluid inlet end and an opposite fluid outlet end;

a rotor mounted on the pintle shaft and configured to rotate relative to the pintle shaft about a rotor axis of rotation, the rotor having a plurality of cylinders;

a plurality of pistons, each being displaceable in each of the plurality of cylinders;

a piston ring disposed around the rotor and having a piston ring axis of rotation, the piston ring configured to rotate about the piston ring axis of rotation as the rotor rotates relative to the pintle shaft about the rotor axis of rotation; and a drive shaft rotatably supported within the housing and rotatable with the rotor;

wherein the pintle includes an integrated bearing surface for supporting rotation of the rotor either directly or by an intermediate fluid, wherein the pintle includes a lubrication groove defined though the integrated bearing surface and configured to feed hydraulic fluid for lubricating the integrated bearing surface, wherein the lubrication groove includes a first pintle lubrication groove that extends through the integrated bearing surface at an exterior of the pintle between the fluid inlet end of the pintle and one of a rotor inlet communication port and a rotor outlet communication port, wherein the lubrication groove includes a second pintle lubrication groove that extends through the integrated bearing surface at the exterior of the pintle between the fluid outlet end of the pintle and one of the rotor inlet communication port and the rotor outlet communication port, the integrated bearing surface integrally formed to surround the rotor inlet communication port and the rotor outlet communication port except for at the first and second lubrication grooves, the rotor inlet communication port formed on the pintle shaft and configured to be selectively in fluid communication with the plurality of cylinders, and the rotor outlet communication port formed on the pintle shaft and configured to be selectively in fluid communication with the plurality of cylinders;

wherein the hydraulic radial piston device is a pump, wherein the first pintle lubrication groove extends between the fluid inlet end of the pintle and the rotor inlet communication port, and wherein the second pintle lubrication groove extends between the fluid outlet end of the pintle and the rotor inlet communication port.

44. A hydraulic radial piston device comprising:

a housing;

a pintle attached to the housing and having a pintle shaft, the pintle having a first end and a second end separated by a length of the pintle, the pintle defining a first fluid channel adjacent the first end and a second channel adjacent the second end;

a rotor mounted on the pintle shaft and configured to rotate relative to the pintle shaft about a rotor axis of rotation, the rotor having a plurality of cylinders;

a plurality of pistons, each being displaceable in each of the plurality of cylinders;

a piston ring disposed around the rotor and having a piston ring axis of rotation, the piston ring configured to rotate about the piston ring axis of rotation as the rotor rotates relative to the pintle shaft about the rotor axis of rotation;

the pintle shaft having an axial dimension that extends along the rotor axis of rotation and a circumferential direction that extends around the rotor axis of rotation; and a drive shaft rotatably supported within the housing and rotatable with the rotor;

wherein an exterior of the pintle shaft includes a bearing surface for supporting rotation of the rotor either directly or by an intermediate fluid, wherein the pintle defines a first rotor communication port in fluid communication with the first fluid channel and a second rotor communication port in fluid communication with the second channel, the exterior of the pintle shaft defining a first recess in fluid communication with the first rotor communication port and a second recess in fluid communication with the second rotor communication port, the bearing surface surrounding the first recess such that first and second opposite axial sides and first and second opposite circumferential sides of the first recess are bound by the bearing surface, the first rotor communication port configured to be selectively in fluid communication with the plurality of cylinders as the rotor rotates, and the second rotor communication port configured to be selectively in fluid communication with the plurality of cylinders as the rotor rotates;

wherein the bearing surface axially and circumferentially bounds the second recess except for a lubrication groove or grooves defined by the exterior of the pintle shaft through the bearing surface, the lubrication groove or grooves providing lubrication of the bearing surface and extending axially along the pintle shaft to an axial side of the second recess.

* * * * *